US011103086B2

(12) United States Patent
Murphy et al.

(10) Patent No.: US 11,103,086 B2
(45) Date of Patent: Aug. 31, 2021

(54) DIFFERENTIALLY KNITTED FIRE BARRIER FABRICS, AND MATTRESSES, MATTRESS FOUNDATIONS, AND UPHOLSTERED FURNITURE ARTICLES EMPLOYING SAME

(71) Applicant: kickball concepts llc, Sterling, VA (US)

(72) Inventors: Harrison R. Murphy, St. Petersburg, FL (US); Juraj Michal Daniel Slavik, II, McLean, VA (US); Kathy Louise Morse Dorrity, Brambelton, VA (US)

(73) Assignee: kickball concepts llc, Sterling, VA (US)

( * ) Notice: Subject to any disclaimer, the term of this patent is extended or adjusted under 35 U.S.C. 154(b) by 156 days.

(21) Appl. No.: 16/681,371

(22) Filed: Nov. 12, 2019

(65) Prior Publication Data

US 2020/0100600 A1 Apr. 2, 2020

Related U.S. Application Data

(63) Continuation of application No. 15/217,649, filed on Jul. 22, 2016, now Pat. No. 10,524,582.

(60) Provisional application No. 62/195,673, filed on Jul. 22, 2015.

(51) Int. Cl.

| | |
|---|---|
| ***D04B 15/00*** | (2006.01) |
| ***A47C 31/00*** | (2006.01) |
| ***D04B 1/04*** | (2006.01) |
| *A47G 9/00* | (2006.01) |
| *A47G 9/02* | (2006.01) |

(52) U.S. Cl.

CPC ..... *A47C 31/001* (2013.01); *D04B 1/04* (2013.01); *D04B 15/00* (2013.01); *A47G 9/0246* (2013.01); *A47G 2009/003* (2013.01)

(58) Field of Classification Search

CPC ..... A47C 31/001; D04B 1/04; D04B 15/00; A47G 9/0246; A47G 2009/003

See application file for complete search history.

(56) References Cited

U.S. PATENT DOCUMENTS

| | | | | |
|---|---|---|---|---|
| 460,655 | A | 4/1891 | White | |
| 2,431,204 | A | 11/1947 | Sheppard | |
| 2,707,381 | A | 5/1955 | Lombardi | |
| 4,092,752 | A | 6/1978 | Dougan | |
| 4,172,165 | A | 10/1979 | Kieckhefer et al. | |
| 4,504,991 | A | 3/1985 | Klancnik | |
| 4,921,756 | A * | 5/1990 | Tolbert ..... | D02G 3/185 428/373 |

(Continued)

*Primary Examiner* — Fredrick C Conley
(74) *Attorney, Agent, or Firm* — Heslin Rothenberg Farley & Mesiti P.C.

(57) ABSTRACT

Knitted fire barrier fabrics for use in forming a flame retardant articles having a core, include for example, a unitarily knitted form comprising a plurality of yarns. The plurality of yarns define the unitarily knitted form having a longitudinal knitted direction, and the unitarily knitted form includes a plurality of differential zones of knitted material extending side-by-side in the longitudinal knitted direction. The knitted fire barrier fabric is disposable on the core so that at least one of the plurality of differential zones of knitted material of the knitted fire barrier fabric provides a differential protective capacity to at least one selected portion of the flame retardant article.

49 Claims, 7 Drawing Sheets

(56) References Cited

U.S. PATENT DOCUMENTS

| | | | | |
|---|---|---|---|---|
| 4,927,698 | A | 5/1990 | Jaco et al. | |
| 5,335,517 | A | 8/1994 | Throneburg et al. | |
| 6,155,084 | A | 12/2000 | Andrews et al. | |
| 6,823,548 | B2 | 11/2004 | Murphy et al. | |
| 6,941,775 | B2 | 9/2005 | Sharma | |
| 7,365,033 | B1 | 4/2008 | Murphy et al. | |
| 7,441,419 | B1 | 10/2008 | Dollyhite et al. | |
| 7,473,659 | B2 | 1/2009 | Sytz | |
| 7,484,256 | B2 | 2/2009 | Murphy et al. | |
| 7,638,192 | B2 | 12/2009 | Murphy et al. | |
| 8,703,631 | B2 | 4/2014 | Sytz | |
| 2007/0148455 | A1* | 6/2007 | Ke | D04H 1/42 428/375 |
| 2009/0132014 | A1* | 5/2009 | Kaminsky | A61F 7/02 607/96 |
| 2017/0020300 | A1 | 1/2017 | Murphy et al. | |

* cited by examiner

DIFFERENTIALLY KNITTED FIRE BARRIER FABRICS, AND MATTRESSES, MATTRESS FOUNDATIONS, AND UPHOLSTERED FURNITURE ARTICLES EMPLOYING SAME

CROSS-REFERENCE TO RELATED APPLICATIONS

This application is a continuation application of U.S. patent application Ser. No. 15/217,649, filed Jul. 22, 2016, entitled "Differentially Knitted Fire Barrier Fabrics, And Mattresses, Mattress Foundations, And Upholstered Furniture Articles Employing Same", which application claims the benefit of U.S. Provisional Application No. 62/195,673, filed Jul. 22, 2015, entitled "Differentially Knitted Fire Barrier Fabrics, and Mattresses, Mattress Foundations, and Upholstered Furniture Articles Employing Same", and which applications are hereby incorporated in their entirety herein by reference.

FIELD OF THE DISCLOSURE

The present disclosure relates generally to knitted fabrics, and more particularly to differentially knitted fire barrier fabrics for articles of furniture such as mattresses, mattress foundations, and upholstered furniture articles.

BACKGROUND

Knitted fabrics are desired and utilized by manufacturers of mattresses and mattress foundations because the stretch and recovery properties typically found in knitted fabric construction do not diminish the feel and consumer perceived comfort of the cushioning materials selected by the manufacturer. The feel elements and perceived comfort of the cushioning materials are key marketing attributes for the manufacturer and their sale of mattresses and mattress foundations, especially at higher retail selling price points. The use of knitted fabrics as the ticking for mattresses and foundations has been widespread. The use of knitted fabrics as the textile construction choice for fire barrier interliners has also been widespread.

There is a need for further knitted fabrics for articles, and more particularly to differentially knitted fire barrier fabrics for articles such as mattresses, mattress foundations, and upholstered furniture articles.

SUMMARY

The shortcomings of the prior art are overcome and additional advantages are provided through the provision, in one embodiment, of a knitted fire barrier fabric for use in forming a flame retardant article having a core. The knitted fire barrier fabric includes, for example, a unitarily knitted form comprising a plurality of yarns, the plurality of yarns defining the unitarily knitted form having a longitudinal knitted direction, and the unitarily knitted form comprising a plurality of differential zones of knitted material extending side-by-side in the longitudinal knitted direction. The knitted fire barrier fabric is disposable on the core so that at least one of the plurality of differential zones of knitted material of the knitted fire barrier fabric provides a differential protective capacity to at least one selected portion of the flame retardant article.

In another embodiment, an article includes, for example, a core, a knitted fabric having a plurality of yarns non-uniformly disposed across a width of the knitted fabric so as to form longitudinally-extending differential zones of material, and wherein the differential zones of material of the knitted fabric being disposed on the core so that the differential zones of material of the knitted fabric provide differential protective capacities to selective portions of the article.

In another embodiment, a mattress or a mattress foundation includes, for example, a core having a top, a bottom, and a peripherally-extending sidewall disposed between the top and the bottom, the core having a width and a length, a knitted fabric comprising a plurality of yarns non-uniformly disposed across the knitted fabric so as to provide differential zones of material in the knitted fabric; and wherein the differential zones of material being disposed over at least a portion of the core.

In another embodiment, a method for forming a knitted fire barrier fabric for a flame retardant article is provided. The method includes, for example, providing a plurality of yarns, and knitting the plurality of yarns non-uniformly around a circumference of a knitting textile cylinder so that the plurality of yarns define a tubular unitarily knitted fire barrier fabric having a longitudinal knitted direction and having a plurality of differential zones of knitted material extending side-by-side in the longitudinal knitted direction. The knitted fire barrier fabric being disposable on a core so that at least one of the plurality of differential zones of knitted material of the knitted fire barrier fabric provides a differential protective capacity to at least one selected portion of the flame retardant article.

These and other objects, features and advantages of the present disclosure will become apparent from the following detailed description of the various embodiments of the disclosure taken in conjunction with the accompanying drawings.

BRIEF DESCRIPTION OF THE DRAWINGS

The subject matter which is regarded as the disclosure is particularly pointed out and distinctly claimed in the concluding portion of the specification. The disclosure, however, may best be understood by reference to the following detailed description of various embodiments and the accompanying drawings in which:

DETAILED DESCRIPTION

Figure 1:
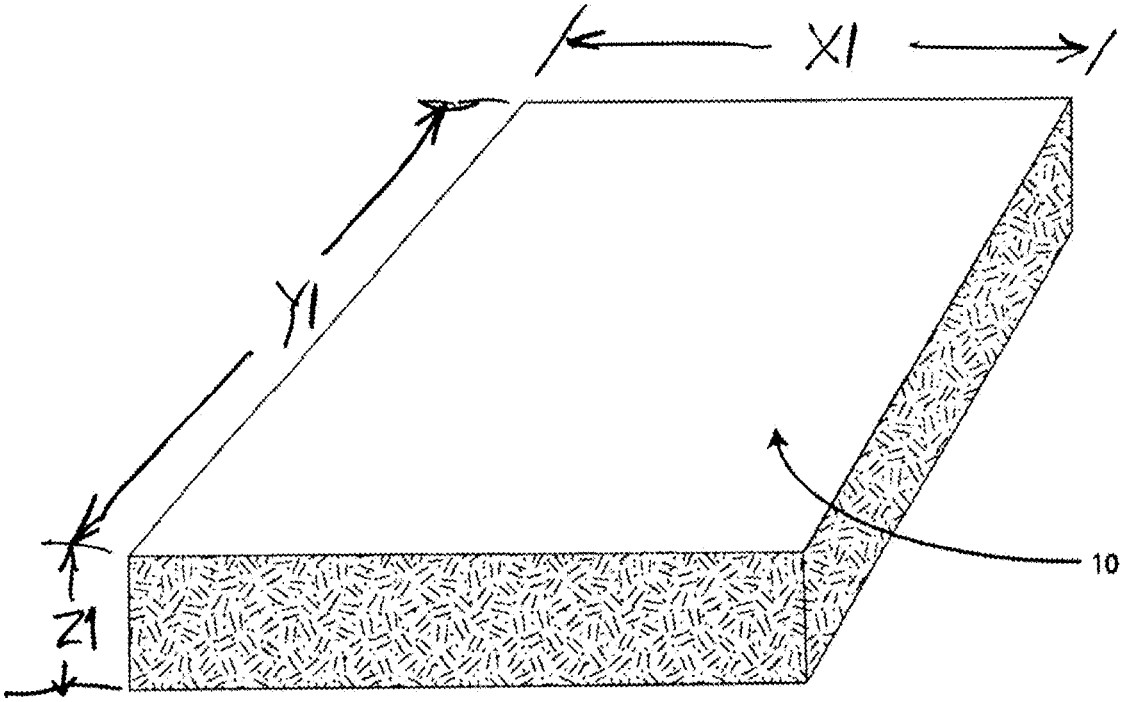
FIG. 1 is a perspective view of a mattress core according to an embodiment of the present disclosure having a resilient filling material of uniform composition.

According to the International Sleep Products Association (ISPA) the domestic US mattress industry shipped mattresses and foundation units in 2013 totaling nearly 36 million pieces or roughly 18 million sets (mattress and foundation) of bedding with a retail value in excess of $13 billion. All mattresses account for approximately 82% of industry sales and foundations account for approximately 18%. Within the mattress sales, the sales of innerspring based mattresses account for 70% and sales of mattresses without innersprings account for the remaining 30% of mattress sales.

Since approximately 2000, there has been a marked shift in mattress design from mattresses manufactured as two-sided units, meaning that the cushioning design was identical on both of the horizontal planar surfaces or "panels" of the mattress, to mattresses that are manufactured as one-sided units, meaning that the cushioning materials and the intended sleeping side of the mattress are localized to only one of the horizontal planar surfaces of the mattress. In consumer marketing, the mattress manufacturers refer to this "improvement" for the consumer as meaning that they no longer have to "flip" their mattress to promote product longevity. An alternative view would be that the mattresses expected life is half or even less than half of the prior design approach. By 2015, the vast majority of all mattresses made for retail sale to consumers in the United States are one-sided designs.

Numerous filling materials are used to construct mattresses, mattress foundations, upholstered furniture articles and other articles filled with resilient cushioning materials. These can be made from foam, fiber or other similar resilient materials.

Manufacturers of flexible polyurethane foam, textile fibers and other resilient filling materials employ a wide variety of technical measurements to communicate the performance attributes engineered into particular foams. Such technical measurements include indentation force deflection (IFD), indentation load deflection (ILD), tensile strength, tear strength, density pounds per cubic foot (PCF), flex fatigue, denier, cut length, and basis weight.

Resilient filling materials may be further differentiated by their composition. In the case of flexible polyurethane foams, for instance, there are visco-elastic foams, gel-infused foams, phase-change or thermos-regulating foams, memory foams, conventional foams, filled conventional foams, high resiliency (HR) foams, modified HR foams, combustion modified foams, and melamine modified foams—all of which can be made at differing densities and hardnesses making the possible total number of combinations potentially limitless. Furthermore, natural and synthetic latex foams are representing an increasing percentage of market share as manufacturers seek to capitalize on the high levels of customer acceptance and purchase of mattresses containing latex-based filling materials.

It is well known to those skilled in the art that flexible foam and resilient cushioning materials can have significantly different levels of volatility and flammability when exposed to open flame or smoldering ignition sources. Some types of foam, for instance latex foams, present a much more difficult fuel load to protect from open flame ignition sources, than the fuel load presented by a plain polyurethane foam. Even within identical material compositions of foams, it has been found that different combustion characteristics exist when the densities of these same foams are varied.

There is a relatively high correlation between the high level of flammability of certain filling materials and higher costs levels of these same materials. For instance, latex foams tend to be very expensive relative to plain polyurethane and other foams and latex foams are typically much more flammable than plain polyurethane or other foams. Because the mattress manufacturing industry places an inordinately high emphasis on containment of raw material costs, the product design process and material selection process are under constant pressure to deliver reduced costs during the purchasing and manufacturing steps. One way that manufacturers have sought to deliver the marketing performance benefits of using more expensive foams while controlling cost impacts is to place thin layers of these types of foams (e.g., latex) atop layers of cheaper foams on the bottom layers of mattresses and place Additionally, many of the more expensive, more flammable foams used in mattress design to promote comfort are not suitable for use throughout the full depth of the mattress because they lack the supportive structure necessary to promote a reasonable degree of mattress life longevity.

These various factors have combined to result in the prevalent design approach of layering higher cost materials with enhanced cushioning properties atop lower cost materials with more structural support properties.

Because mattress manufacturers have gravitated toward the design selection of using highly flammable foams with high levels of comfort in their offerings the suppliers of fire barriers have had to re-engineer their offerings used to meet full-scale open flame testing requirements by these mattress manufacturers. One customary means of achieving the protection is to make the fabric more protective by using increased masses of fire resistant yarns and fibers in the design of barriers. Another customary means is to employ flame retardant chemical treatments intended to stymie the combustion of the mattress or mattress foundation when exposed to an ignition source. While some flame retardant chemical treatments can be applied to textile structures in ways to promote their durability and longevity, that least-expensive treatments have the potential for chemical leaching and migration which may be deemed undesirable and pose unacceptable risks of non-performance or performance degradation over time.

The implementation of the Federal Standard for the Flammability (Open Flame) of Mattress Sets; Final Rule 16 CFR 1633 has mandated that all mattresses sold in the United States meet an open flame, full-scale fire test.

Incorporating fire barrier fabrics into the internal structure of mattresses and mattress foundations has also been caused by the increased adoption of the NFPA 101.®. Life Safety Code by the Federal government (Centers for Medicare and Medicaid), states (more than 40), localities, and private accreditation bodies (Joint Commission on Accreditation of Healthcare Occupancies—JCAHO). NFPA 101 call for introduction of new mattresses and upholstered furniture into high risk occupancies (e.g., hospitals, detention facilities, dormitories, etc.) that meet restricted rates of heat release when exposed to open flame ignition.

The need to incorporate fire barrier fabrics into the internal structure of upholstered furniture articles and other filled furnishings items will also increase with the activity in the areas of mandating open flame resistance in furniture and bedding through efforts such as the draft language of 16 C.F.R. 1634, as published by the CPSC in May 2005, and incorporated in their entirety herein by reference, the California BHFTI draft of Technical Bulletin #604 published Oct. 1, 2004, and the ANPR for 16 CFR 1634 Standard To Address Open Flame Ignition of Bedclothes published by the CPSC in the Federal Register on Jan. 13, 2005, pages 2514 through 2517, both of which are also incorporated in their entirety herein by reference.

Compliance with full scale, open-flame ignition test performance requirements is typically achieved by mattress and furniture manufacturers by installing a fire barrier material, e.g., a fabric or batting, directly beneath the outermost covering materials used to make the mattress or article of upholstered furniture.

The composition of the barriers varies widely across a diverse manufacturing base of material suppliers. In some instances, materials selected for fire barrier design are inherently flame retardant materials that are physically stable and pose little or no risk to end-users from material degradation and migration of particulate matter or chemical traces away from the barrier structure. Alternatively, however, some material suppliers have chosen less-expensive and potentially less durable solutions, such as topically applying chemical solutions such a boric acid powder to staple fibers or finished fabric barrier offerings. Such approaches may not offer the physical stability and resistance to degradation offered by more expensive solutions.

The vast majority of mattresses are currently made open flame resistant by use of non-woven fire barrier materials. Non-wovens possess a cost advantage over other yarn-based textile structures because the costs and working losses associated with the yarn formation steps of manufacture are not incurred. However, non-wovens are limited in the desirability of their use in that they do not possess stretch and recovery attributes and can mask the desirable comfort features and "feel" of higher end mattress filling materials.

Textile structures used in fire barrier fabrics to promote compliance with full-scale open flame resistance regulatory performance requirements have heretofore been uniform in their construction. Non-woven fabrics have had a consistent material weight across the entirety of the product width; woven fabrics have also been uniform in the use of similar yarns in either the warp or fill orientations and the use of yarns in knitted constructions has also been similarly uniform.

In certain knitting approaches used to make fire barrier fabrics, the fabric formed directly from the manufacturing process is tubular or cylindrical in form. The fabrics made have been used in both the tubular, greige form as they emerge directly from the manufacturing process or can slit along one side and laid open at a width appropriate for use in a flat fabric manner. One advantage of using knitted fabric in a tubular form directly as manufactured is that the installation is straightforward and little additional cost is required for the installation onto the mattress core as the fire barrier structure can be installed similar to pulling a sock onto a foot.

If the material is slit open from the tubular form, it can be either quilted into the traditional ticking construction or fashioned into a "pop-on" cap style assembly, similar to the design of a fitted sheet or a shower-cap with a sewn hem that may or may not be elasticized to promote fit and positioning stability, that is installed interior to the ticking assembly and covers the topmost horizontal planar face of the mattress, the four vertical planar faces ("borders") of the mattress and a limited perimeter of the bottom horizontal planar face of the mattress, but not the totality of the bottom panel. The "cap" approach can afford the totality of the mattress design with sufficient protection from ignition sources present in full-scale testing, because the fire insult is typically localized to the top and side of the mattress only and does not impinge on the bottom horizontal planar face to a great degree. Further supporting the "cap" approach is the use of flame-retardant filler-cloth or non-skid decking fabric that is not attached to the "cap" assembly and is located on the bottom of the mattress ticking cover assembly that may be found to sufficiently protect the design even if the barrier does not extend to fully cover the bottom surface of the mattress core.

Historically, while the use of single yarn ends or multiple, plaited yarn end configurations in certain knitted fire barrier fabric constructions has been commonplace in an effort to tailor the material to cost and performance requirements, the selection, placement and orientation of the yarn ends has been consistent and uniform around the circumference of the knitting cylinder so as to make fabric of uniform construction.

Many of the foams or filling materials that manufacturers select to promote more comfort and better sleep are concurrently more costly and more flammable. As such, and in concert with previously mentioned one-sided mattress design approach, the propensity of the design is now to stack the cushioning elements in such a manner as to dispose the more costly, more comfortable and more flammable.

The protective capability of fire barrier fabrics, specifically those fashioned by knitting, have heretofore been achieved by forming a textile structure that is uniform around the circumference of the knitted fabric in terms of yarn placement. This has not adequately matched the solution to the latent flammability challenge of the composite article and has resulted in an inefficient use of raw materials.

The present disclosure is directed to using a differential approach to knitting the yarns disposed in zones around the circumference of the knitted fabric so as to deliver differential levels of protective capacity that affords a barrier solution with the ability to be custom tailored so as to place either particular yard compositions or increased aggregate masses of flame retardant materials most proximate to the fuel loads present in the composite article. Utilizing placement of yarns to impart textures, such as knitting stiches or selvedges that emphasize or provide visual identification of the transition from one yarn to another are fully contemplated by the present disclosure as a means to facilitate proper installation and matching of zones within the tubular structure to the appropriate areas of the mattress core requiring protection from the fire barrier system.

There have been differential approaches to knitting fabrics, however the prior-art cited herein suggest that these efforts have been limited to garments and hosiery and that the impetus of such efforts have been entirely for aesthetic and cushioning purposes and not with an eye toward fire-blocking or fire-prevention. Furthermore, the knitting equipment utilized in hosiery applications is specifically narrow in the diameters of material that it is able to manufacture as opposed to the cylinder diameters utilized in fabrics knitted to accommodate the girth of mattresses and the nature of flame retardant materials utilized would be a substantive departure from the yarns customarily used or suggested for use from the examples of prior art.

It is currently customary in the field of knitted mattress fire blocking barrier design to knit the fabric so that the relaxed tubular width of the fabric in the greige state is some degree less than the aggregate girth of the composite article being covered or protected by the knitted fire barrier fabric. Mattress sizes are standard as indicated in Table 1.

TABLE 1

| Product Size | Dimensions (L × W) | Market Share 2013 | Total Girth of 10" Thick Mattress |
|---|---|---|---|
| Twin | 38.0" × 74.5" | 20.1% | 96.0" |
| Twin XL | 38.0" × 79.5" | 2.3% | 96.0" |
| Full | 53.0" × 74.5" | 15.4% | 126.0" |
| Full XL | 53.0" × 79.5" | 0.9% | 126.0" |
| Queen | 60.0" × 79.5" | 40.0% | 140.0" |
| King | 76.0" × 79.5" | 15.0% | 172.0" |
| Cal King | 72.0" × 84.0" | 2.1% | 164.0" |
| Other | Varied | 4.2% | Varied |

TABLE 1-continued

| Product Size | Dimensions (L × W) | Market Share 2013 | Total Girth of 10" Thick Mattress |
|---|---|---|---|

Source: 2013 Mattress Industry: Report of Sales & Trends, ISPA (International Sleep Products Association), 2014.

For instance, a typical twin sized mattress with industry standard nominal dimensions of 38.0 inches wide by 74.5 inches in length and 10 inches thick would have a girth from side-to-side of 96 total inches (38 plus 38 plus 10 plus 10 equals 96). Typically a knitted barrier in tubular form to cover this size would be knitted at an approximate width of 30 to 34 inches in tubular form. As this is two layers of fabric laid flat atop one another and able to cover a linear girth of only 60 to 68 inches without stretching, the fabric would therefore have to stretch/expand from its relaxed state to properly accommodate the girth of the mattress. The tubular fabric would have to stretch from approximately 38% to as much as possibly 56% (depending on the originally knitted tubular dimension) from its relaxed state. As such, the basis weight of the fabric as knitted would be dispersed by this expansion factor and therefore the differential protective capability would be effectively reduced by the inverse of the degree of stretch required to accommodate the installation.

More specifically, using a knitted fabric selected for a twin size mattress and designed to achieve a material basis weight of 5.0 ounces per square yard in the greige, relaxed state, would have to be stretched to go on to a standard twin size mattress. The stretching of the tubular/cylindrical material from a girth of 32" tubular width (64" girth) to 96" girth would cause the material weight to be reduced to an amount of 3.33 ounces per square yard. Similar material dispersions would be expected in other tubular widths of fabric used to cover other sizes of mattresses and mattress foundations.

In knitting, the set-up configuration of numerous parameters can play a significant role in the fabric that is produced. Needle counts, cylinder diameter, needle gauge, run-in revolutions, tightness or looseness of stitches and other parameters can be adjusted to deliver differences in the knitted fabric that affect the weight, width and degree of stretch among other attributes.

The present disclosure seeks to utilize the adjustments and yarn selections that can be made through the knitting process so as to localize the placement of specific yarns or yarn combinations in a differential manner so that by varying the concentration of the flame retarding properties and characteristics of the yarns or yarn combinations may be most optimally matched to the fuel load profile of the mattress or mattress foundation.

The differential, dissimilar characteristics of the zones created in the textile structure disclosed herein may be accomplished by adjustments to the settings of the production machinery but also may be achieved by selecting yarns of varying sizes. The density of a zone created by a coarse yarn, for instance having a yarn size larger than 14/1 cotton count, would be expected to be greater than the density created by a relatively finer yarn, for instance having a yarn size smaller than 14/1 cotton count, if all other adjustable parameters of the knitting production equipment were to be held constant. It would be well known to those skilled in the field of knitting textiles that the myriad of variable elements available in textile structure design can achieve comparable outcomes in a wide variety of different manners.

Furthermore, the present disclosure fully contemplates that in addition to providing for differential placement and selection of yarns or yarn combinations around the knitting cylinder to achieve differential zones of material construction, that certain knitting approaches, such as terry and velour knitting approaches could be used in portions of the cylinder arrangement to create greater relative material density in localized areas and not used in other portions of the cylinder arrangement where a lower relative material density may be adequate.

The present disclosure, in addition to contemplating the production of a tubular, knitted fabric with differential zones of fire protection achieved through yarn selection and placement, also provides for the visual identification of the differential zones so as to promote proper installation of the material.

One benefit, however, of the present disclosure is that presently to form the cap solution, the additional manufacturing steps of cutting and sewing, with additional cost must be undertaken and if a zone of fabric is knitted into the circumference of the material is of a non-flame retardant yarn selection, such section could be disposed during installation to the bottom horizontal planar surface of the mattress core structure. The need to provide protection to "worst-performing" foam or filling type chosen by the mattress manufacturer has historically been a key factor in dictating the design elements of the fire barrier, specifically as it related to material weight and composition.

Throughout this specification the terms are defined when first introduced and retain their definitions.

A mattress and terms relating to mattresses are defined below and conform to the terms as defined by 16 C.F.R. 1632, the entire contents of which are incorporated herein by reference. Additionally, the terms defined below conform to the terms as defined in the NPR on Mattress Flammability of 16 CFR 1633 as approved by the CPSC on Feb. 16, 2006, the entire contents of which are incorporated herein by reference.

A mattress means a ticking filled with a resilient material used alone or in combination with other products intended or promoted for sleeping upon. Examples include but are not limited to adult mattresses; youth mattresses; crib mattresses such as portable crib mattresses; bunk bed mattresses; futons; water bed; and air mattresses which contain upholstery material between the ticking and the mattress core; and any detachable mattresses used in any item of upholstered furniture such as convertible sofa bed mattresses, corner group mattresses, day bed mattresses, roll-a-way bed mattresses, high risers, and trundle bed mattresses. A mattress may also be called a bed.

Examples excluded from the above definition include sleeping bags; pillows; mattress foundations; liquid and gaseous filled tickings such as water beds and air mattresses which do not contain upholstery material between the ticking and the mattress core; upholstered furniture which does not contain a detachable mattress such as chaise lounges, drop-arm love seats, press-back lounges, push-back sofas, sleep lounges, sofa beds (including jackknife sofa beds), sofa lounges (including glide-outs), studio couches and studio divans (including twin studio divans and studio beds); and juvenile product pads such as car bed pads, carriage pads, basket pads, infant carrier and lounge pads, dressing table pads, stroller pads, crib bumpers, and playpen pads.

A mattress pad means a thin, flat mat or cushion, and/or ticking filled with resilient material for use on top of a mattress. Examples include but are not limited to absorbent mattress pads, flat decubitus pads, and convoluted foam pads, which are totally enclosed in ticking. Examples excluded from the definition are convoluted foam pads, which are not totally encased in ticking.

Ticking means the outermost layer of fabric or related material that encloses the core and upholstery materials of a mattress or mattress pad. A mattress ticking may consist of several layers of fabric or related materials quilted together.

Core means the main support system that may be present in a mattress, such as springs, foam, hair block, water bladder, air bladder, or resilient filling.

Upholstery material means all material, either loose or attached, between the mattress or mattress pad ticking and the core of a mattress, if a core is present.

Tape edge (edge) means the seam or border edge of a mattress or mattress pad.

Quilted means stitched with thread or by fusion through the ticking, and one or more layers of upholstery material.

Tufted means buttoned or laced through the ticking and upholstery material and/or core, or having the ticking and upholstery material and/or core drawn together at intervals by any other method which produces a series of depressions on the surface.

A mattress foundation is any surface such as foam, box springs or other, upon which a mattress is placed to lend it support for use in sleeping upon.

An article of upholstered furniture is a resilient filling material that may optionally be supported by a frame or structure and is encased by a textile structure. The article of upholstered furniture is intended to be used for sitting or reclining but is not primarily intended for sleeping and conforms with the term as defined by the draft language of 16 C.F.R. 1634, as published by the CPSC in May 2005, the entire contents of which are incorporated herein by reference.

A filled article is resilient filling material encased in a textile structure and a bedding is a textile bedding product that is used on or in conjunction with a bed, mattress or mattress foundation and the terms relating to filled articles and bedding conform with the terms as defined by the California BHFTI draft of Technical Bulletin #604 published Oct. 1, 2004, and the ANPR for 16 CFR 1634 Standard To Address Open Flame Ignition of Bedclothes published by the CPSC in the Federal Register on Jan. 13, 2005, pages 2514 through 2517, the entire contents of which are incorporated herein by reference.

A textile structure is any type of material made from fibers or other extended linear materials such as thread or yarn. Classes of textile structures include woven fabrics, knitted fabrics, including circular and warp knitted fabrics, crocheted fabrics, knotted or tufted cloth and non-woven fabrics, such as felt, high loft, spunlaced, hydroentangled, airlaid or needlepunched fabrics. A textile structure also encompasses composites of multiple textile structures that may include the foregoing textile classes.

One embodiment according to the present disclosure includes, for example, a knitted fire barrier having inherently flame retardant yarns that is non-uniform in terms of yarn selections or concentrations and wherein such yarn selections or concentrations are made so as to attempt to match the protective capability of the yarns selected or densities of yarns to the flammability hazard, however it is contemplated that the technique of the present disclosure of differential or zonal yarn placement may be applicable to all textile structures formed from yarns or threads and that, furthermore, the present disclosure would not be intended to be limited if chemically treated flame retardant yarns or threads were used in lieu of or in concert with the inherently flame retardant yarns disclosed herein.

A fire barrier fabric according to the present disclosure, for example, functions to protect a mattress and/or foundation from fire by forming a char when exposed to an ignition source. In the context of the present disclosure, the term "char" is defined as a residue formed from material that has been exposed to heat and/or flame, and which is no longer flammable. The char may be formed from materials that have been incompletely burned and extinguished, or from materials that do not react chemically under conditions found in a fire, and so, are not flammable, such as fiberglass. The char may also possess mechanical strength and integrity and so can act as a physical barrier to prevent flames from contacting highly combustible interior fill components of mattresses and mattress foundations. In addition, it is desirable that the char should not melt, drip or shrink away from the ignition source, or display significant after-flame, or support these reactions at a level sufficient to cause ignition of adjacent materials.

Accordingly, a fire barrier layer may be composed of at least one char-forming flame-retardant fiber. The layers may be composed of the same fiber or different fibers. Any char-forming flame retardant fiber may be used for either layer, and the following fibers have been found to be particularly useful: aramids, including para-aramids (poly (p-phenylene terephthalamide), e.g., KEVLAR® (E.I. Dupont) and TWARON® (Teijin Twaron BV) and meta-aramids (poly(m-phenylene isophthalamide), such as Nomex® (E.I.Dupont); fiberglass; melamines such as BASOFIL® (BASF); poly-benzimidazole (PBI) (Celanese Acetate A.G); oxidized polyacrylonitrile (PAN); novoloids, such as KYNOL®. (American Kynol, Inc); pre-oxidized fibers and carbon fibers, modacrylics, such as, e.g., KANECERON® and PROTEX® (Kaneka), FR (fire- or flame-resisting, -resistant, -retarding or -retardant) rayon, FR viscose, such as, e.g., VERIFIBER® TCF FR Rayon (Ventex, Inc.) and LENZING FR® (Lenzing A G, Fibers Division), wool and FR-treated cotton. It should be noted that these fibers are merely exemplary, and other fire-retardant fibers that form a char, including fibers that are developed in the future may be used. Additionally, certain proprietary modacrylic fibers that release extinguishing/oxygen depriving elements such as antimony when exposed to an ignition source may be used. This chemical reaction may assist in snuffing out small flames that may occur on adjacent, non-FR components such as the mattress covering fabric or ticking. Blends that include at least one fire-retardant fiber that form a char may also be used. The blends may include one or more structure-providing char-forming fire-retardant fibers, FR-treated fibers, such as FR-treated polyester, and non-FR fibers.

In some embodiments of the present disclosure, a knitted fire-retardant fabric may be composed entirely of high temperature fibers that are inherently flame and heat resistant and promote char formation and char integrity.

It is fully contemplated, however, by the present disclosure that certain, non-flame retardant fibers and yarns may be utilized to enhance the knitted fabric in performance areas other than flammability protection. Use of elastomeric materials, such as Spandex®, Lycra® or similar materials can be used to impart stretch and recovery attributes that enable the knit to mimic the compression of the foam based filling materials and therefore be perceived as "invisible" to the end-user and not diminish the feel of the filling material. Use of non-flame retardant fibers and yarns such as cotton, polyester, nylon and acrylics, among others, may be used in areas intended to be placed at the bottom, horizontal planar surface of the mattress or mattress foundation may be possible and the composite article may still pass the requirements of full scale fire testing as these regions of the mattress design may be less susceptible to impingement from the ignition sources of the testing or are protected by other elements of the mattress or mattress foundation design.

However, while the various embodiments described herein, are drawn to yarns and fibers that are inherently flame retardant as being most desirable for placement in closest proximity to the most volatile fuel load zones of the composite article to be protected, it is contemplated that producing a knitted fabric with differential yarn selections that are not inherently flame retardant may also provide for passing test results when the fabric is chemically treated and the yarns are selected to be positively receptive of chemical flame retardant treatments.

For instance, a barrier may be constructed of entirely cotton yarns or rayon yarns, cotton and rayon being a cellulosic fibers and receptive of chemical flame retardant treatments. By bulking up the concentration of cotton yarns in areas of higher fuel load volatility relative to the concentration on the bottom of the mattress in areas removed from the areas of higher fuel load volatility, the increased mass of cotton or rayon would permit higher levels of chemical flame retardant "take-up" and therefore permit the matching philosophy of barrier level to threat level to be achieved.

Specific design parameters, such as weight of the finished fabric, blend levels of fibers or yarns used and the choice of knitting construction, are not critical. Weight of a fire barrier layer can range from between 0.25 oz. and 40 oz. per square yard in an effort to appropriately address the differing burning characteristics that may be present in the vertical and horizontal surfaces of the mattress and foundation, however it is contemplated that even greater weights may be required to address particularly volatile and highly flammable designs. Since the protection levels required for different mattress constructions are based on the fuel load they represent, a range of configurations and combinations of elements that make up fire barrier fabric according to the present disclosure is envisioned. A relatively low finished fabric weight containing fibers which do not perform at the highest level and therefore would not be at the high end of the cost spectrum may be appropriate for an inexpensive sleep set representing a minimal fuel load. A higher finished fabric weight and composition including very high-performing fibers at a higher cost may be appropriate protection for particularly challenging mattress constructions, such as an extra-thick, premium pillow-top constructions, overfilled with combustible materials in the quest for luxury and comfort. A particular composition appropriate for given circumstances is typically determined by full-scale testing of a mattress incorporating a proposed design. Ancillary considerations for design of a fire barrier fabric for use in fire resistant mattresses and mattress sets of the present disclosure include cost factors associated with raw material components and assembly methodologies, ability to integrate the fabric into existing production processes for mattress manufacturers, potential health hazard issues associate with the chemical makeup of raw materials used in the design and manufacture of the fire barrier fabric, durability of the fabric itself and of the mattress or mattress set once the fabric is incorporated into the finished mattress design, and the impact of the product on the comfort elements that are critical to market acceptance of the mattress or sleep surface.

It is not necessary that fire barrier fabrics according to the present disclosure be finished, that is bleached, dyed, scoured, heat-set, pre-shrunk, as these steps typically add cost to the finished product without any additional aesthetic benefit, as the fabric is typically concealed from view. Therefore, the greige state of the fabric is typically sufficient.

However, if finishing were desired, such would not materially affect performance of the fabric. Mattress manufacturers may employ objective measures of this using a process referred to as pressure mapping.

While some embodiments of the present disclosure may be formed by circular knitting, it is fully contemplated that other knitting approaches may be employed with the teachings herein to deliver comparable results. Such knitting approaches may include but not necessarily be limited to weft knitting, warp knitting, pile fabrics, plain knits, rib knits, jersey knits, double knits, cardigan knits, velour knits and the variety of combinations that may be derived by using multiple knitting constructions in a unitarily formed continuous textile article. It is further contemplated that traditional, mechanical knitting approaches, as well as more advanced electronically controlled knitting approaches may be utilized to achieve the desired results recited herein.

FIG. 1 depicts a mattress core solely including a resilient filling material of uniform composition according to an embodiment of the present disclosure. The mattress core 10 may be a uniform foam selection as shown in this figure. This "full-depth" approach is one the more rudimentary of approaches to construct the core of the mattress. The selected foam could be relatively low in terms of the material volatility when subjected to an open-flame or smoldering ignition source. A flame-retarded, polyurethane foam would be considered to be relatively low in terms of expected flammability level, whereas a latex foam (either natural or synthetic) would be anticipated to be relatively high in terms of its expected flammability level. The former would be substantially less expensive in relative terms compared to the latter. Mattress core 10 may have a width X1, a length Y1, and a depth of thickness Z1, for example, corresponding to the table above.

Figure 2:
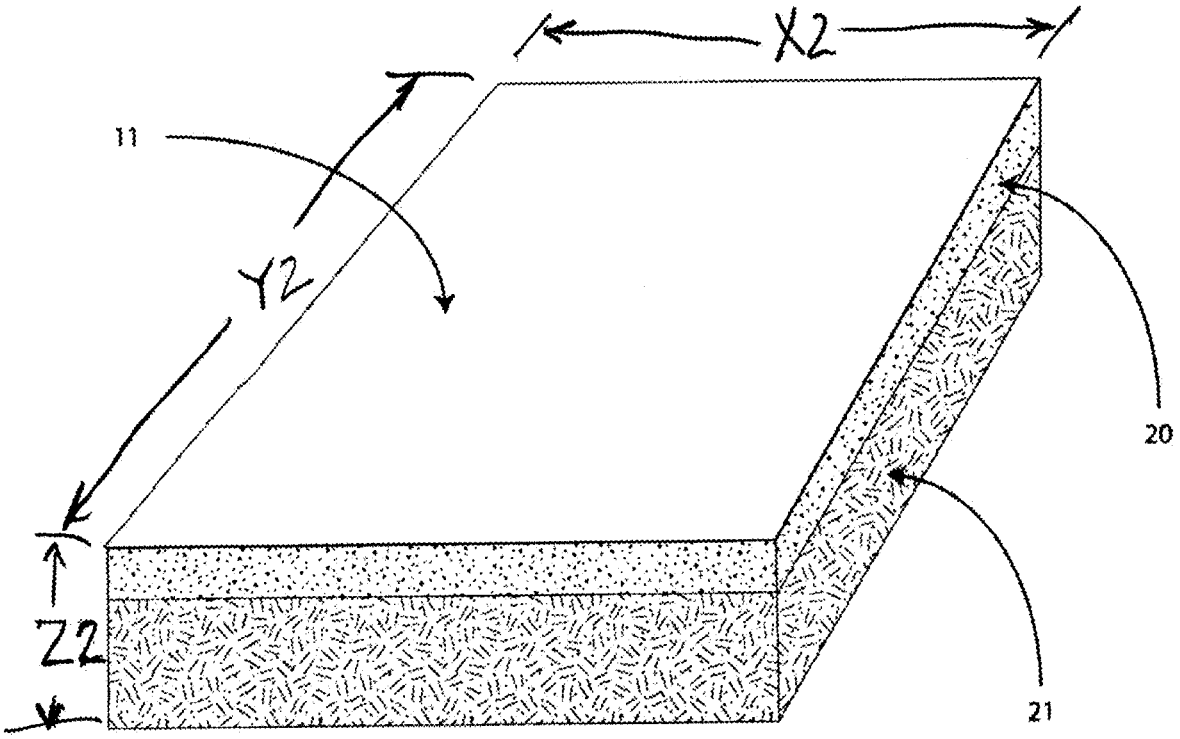
FIG. 2 is a perspective view of a mattress core having two distinct resilient filling material layers according to an embodiment of the present disclosure, wherein the topmost layer is selected from a resilient filling material that is of a more highly flammable nature than that the bottom-most layer of resilient filling material.

FIG. 2 depicts a mattress core having two distinct layers of resilient filling material according to an embodiment of the present disclosure, wherein the topmost layer is selected from a resilient filling material that is of a more highly flammable nature than that the bottom-most layer of resilient filling material. The mattress core 11 may include of a top-layer of foam 20 possibly selected from an expensive, highly flammable foam, for example latex, and a bottom-layer 21 possibly selected from a less-expensive, less flammable foam, for example polyurethane. Mattress core 11 may have a width X2, a length Y2, and a depth of thickness Z2, for example, corresponding to the table above.

Figure 3:
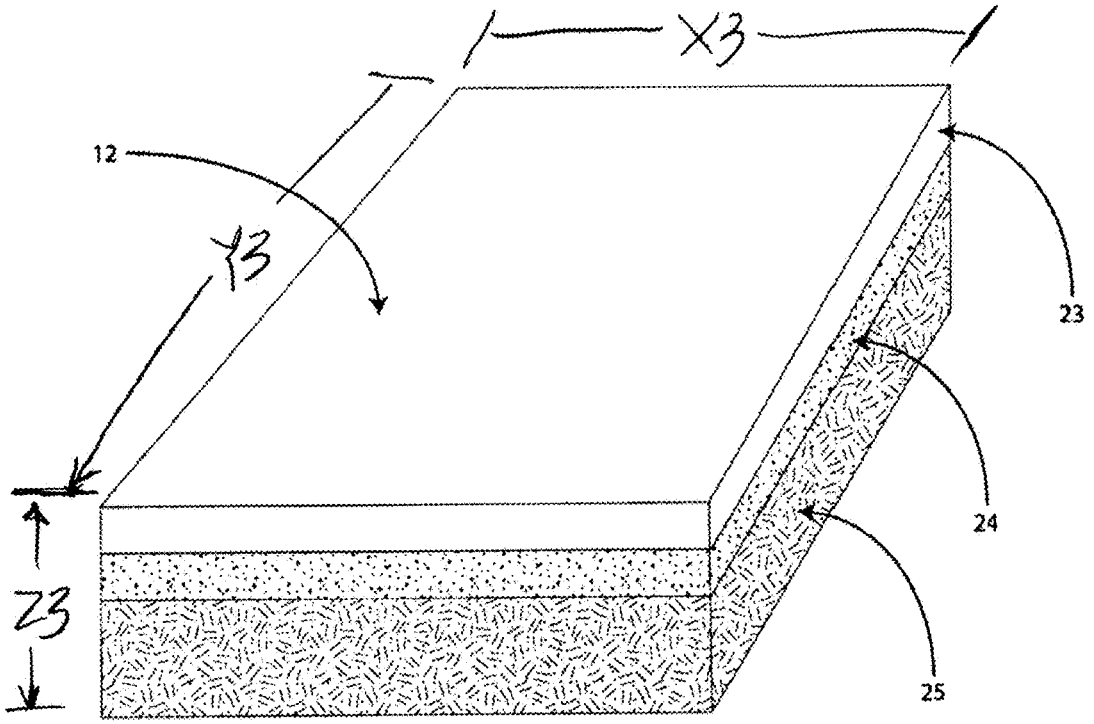
FIG. 3 is a perspective view of a mattress core having three distinct resilient filling material layers according to an embodiment of the present disclosure, wherein the topmost layer is selected from a resilient filling material that is of a more highly flammable nature than that of the middle or the bottom-most layer of resilient filling material and the middle layer is more highly flammable than the bottom-most layer of resilient filling material.

FIG. 3 depicts a mattress core 12 having three distinct layers of resilient filling material according to an embodiment of the present disclosure, wherein a topmost layer 23 is selected from a resilient filling material that is of a more highly flammable nature than that of a middle layer 24 or a bottom-most layer 25 of resilient filling material and middle layer 24 is more highly flammable than bottom-most layer 25 of resilient filling material. Alternatively, the distinct layers of material selected may not be progressive in ordering of their relative flammability. The present disclosure provides for the ability to match the protective capacity of the differential zones to the particular flammability hazards presented. It is also contemplated that mattresses of more than three distinct layers may be formed and that the disclosure recited herein could be further modified as taught to match to such a plurality of layers. Mattress core 12 may have a width X3, a length Y3, and a depth of thickness Z3, for example, corresponding to the table above.

Figure 4:
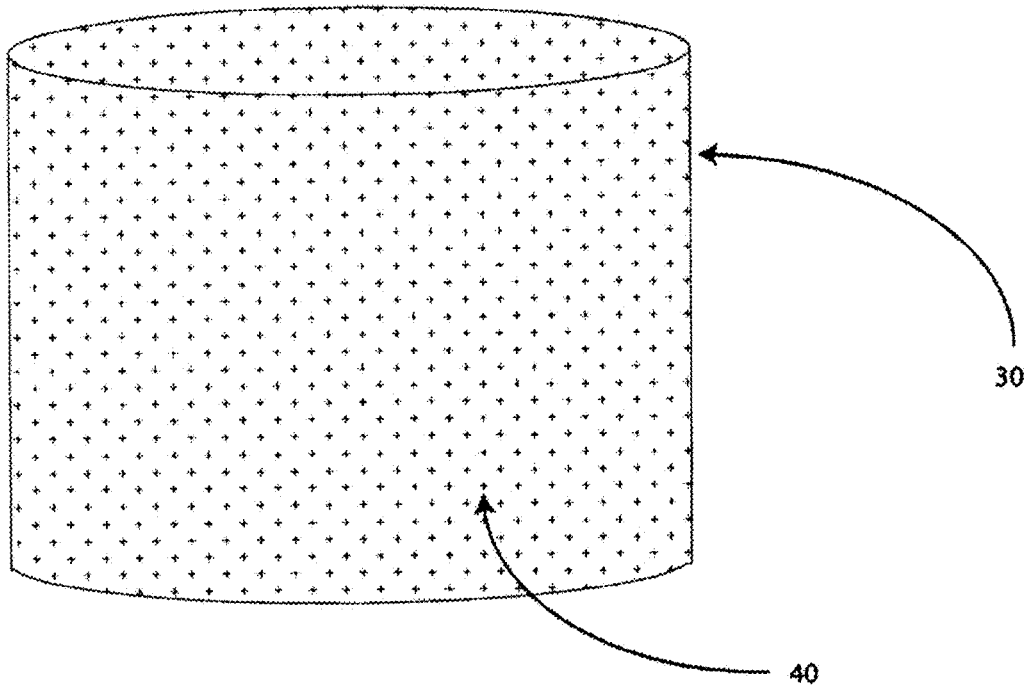
FIG. 4 (PRIOR ART)
FIG. 4 is a perspective view of a prior art knitted fire barrier fabric that includes a uniform and consistent placement of individual or plaited yarns or thread formed around a circumference of a knitting cylinder.

FIG. 4 depicts a knitted fire barrier 30, as taught by the prior art and known well to those skilled in the art, having a uniform and consistent placement of individual or plaited yarns 40 or thread around a circumference of a knitting cylinder (not shown in FIG. 4). Such a barrier is customarily a rib knit or jersey knit construction but may be fashioned from other circular knitting constructions as well.

Figure 5:
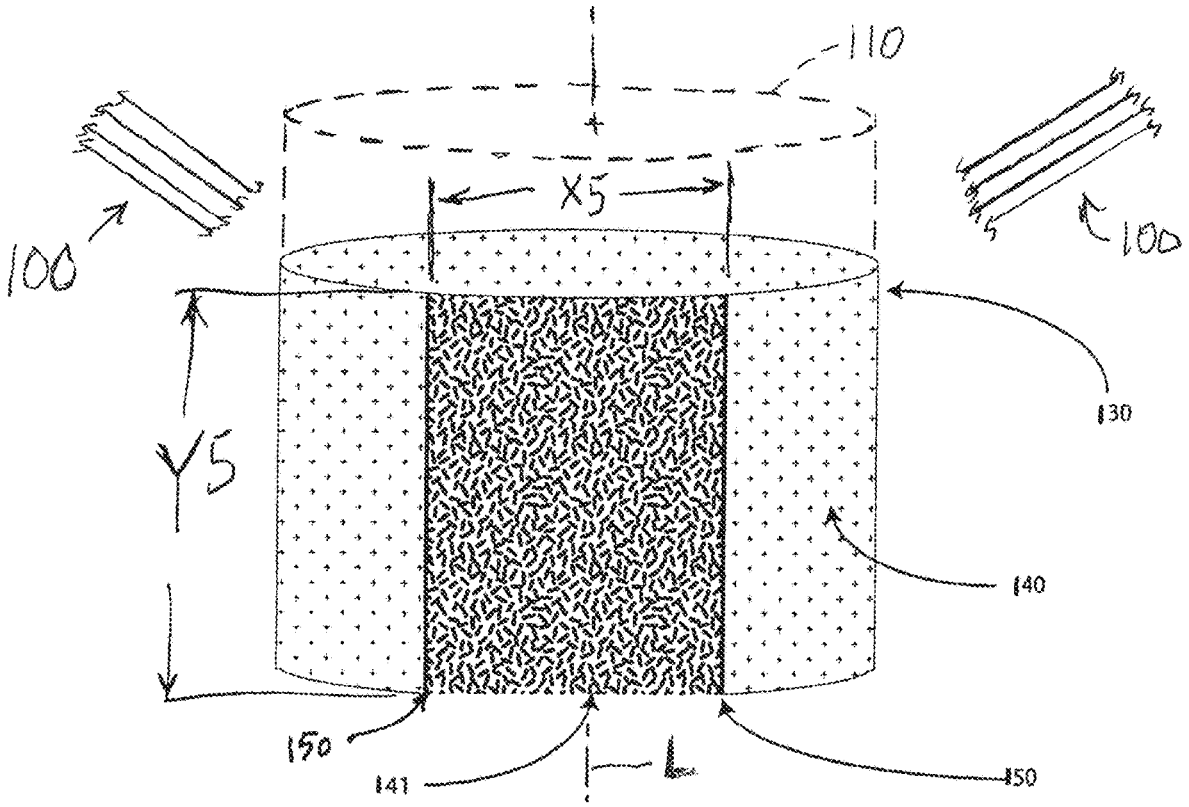
FIG. 5 a perspective view of a knitted fire barrier fabric according to an embodiment of the present disclosure that includes a non-uniform and non-consistent placement of individual or plaited yarns or thread formed around a circumference of a knitting cylinder. Such non-uniform, non-consistent placement yields a two-zone fabric whose zones are however proportionally matched to the anticipated placement of the knitted fire barrier fabric over or against the exposed surfaces or edges of the mattress core of the design similar to FIG. 2. The knitted fire barrier fabric depicted in FIG. 5 could also be utilized on the mattress core of the design depicted in FIG. 1 as an alternative to a pop-on cap approach that would leave the bottom exposed and the bottom zone may be non-flame retardant.

FIG. 5 depicts a knitted fire barrier fabric 130 according to an embodiment of present disclosure that may include a non-uniform and non-consistent placement of individual or plaited yarns or thread 100 around a circumference of a knitting cylinder 110 (shown in dashed lines). Such non-uniform, non-consistent placement yields a two-zone knitted fire barrier fabric, having a first area or zone 140 and a second area or zone 141, whose areas or zones are proportionally matched to the anticipated placement of the barrier fabric against exposed edges of a mattress of design similar to FIG. 2. The knitted fire barrier fabric depicted in FIG. 5 is also intended to be able to be utilized on a mattress of the design depicted in FIG. 1 as an alternative to a pop-on cap approach that would leave the bottom exposed and second zone 141 could be oriented on the mattress so as to only cover the bottom horizontal planar surface. For ease and accuracy of installation, the embodiment depicted in FIG. 5 shows identifiers 150 that may optionally be integrated into the knitted fire barrier fabric during the knitting process and may include a knitting pattern variation, such as a selvedge. The identifiers are intended to assist those installing the barrier over the mattress core to properly orient the differential zones against the intended areas or layers of the mattress core. For example, knitted fire barrier fabric 130 may be cut such as transverse to a longitudinal knitted direction L from a tubular knitted fire barrier fabric.

First area or zone 140 and a second area or zone 141 may include fire-retardant yarns, or first area or zone 140 may include non fire-retardant yarns, and second area or zone 141 may include fire-retardant yarns. The areas or zones may include a combination of non fire-retardant yarns and fire retardant yarns. Other possible types of yarn for the various areas or zone are possible as described further herein.

For example, second area or zone 141 may have a width X5 and a length L5. In some embodiments, such as where knitted fire barrier fabric 130 is generally not stretchable, second area or zone 141 may have width X5 that corresponds to a width of a core of a mattress or a mattress foundation (e.g., corresponding to width X1 of core 10 (FIG. 1)), and length L5 that is greater than a length of a core or a mattress or a mattress foundation, (e.g., greater than length Y1 of core 10 (FIG. 1)). Length L5 may be slightly larger than a combined length and thickness of a core. In other embodiments, such as where knitted fire barrier fabric 130 is not stretchable, second area or zone 141 may have width X5 that is greater than a width of a core or a mattress or a mattress foundation (e.g., less than width X1 of core 10 (FIG. 1) so as to extend over the edges and at least a portion or all of the depth or thickness of the core. In some embodiments, such as where knitted fire barrier fabric 130 is stretchable, second area or zone 141 may have a width X5 that corresponds to a width of a core of a mattress or a mattress foundation or less than the width of a core of a mattress or mattress foundation, and have length Y5 that is the same or less that the length of a core of a mattress or mattress foundation.

Figure 6:
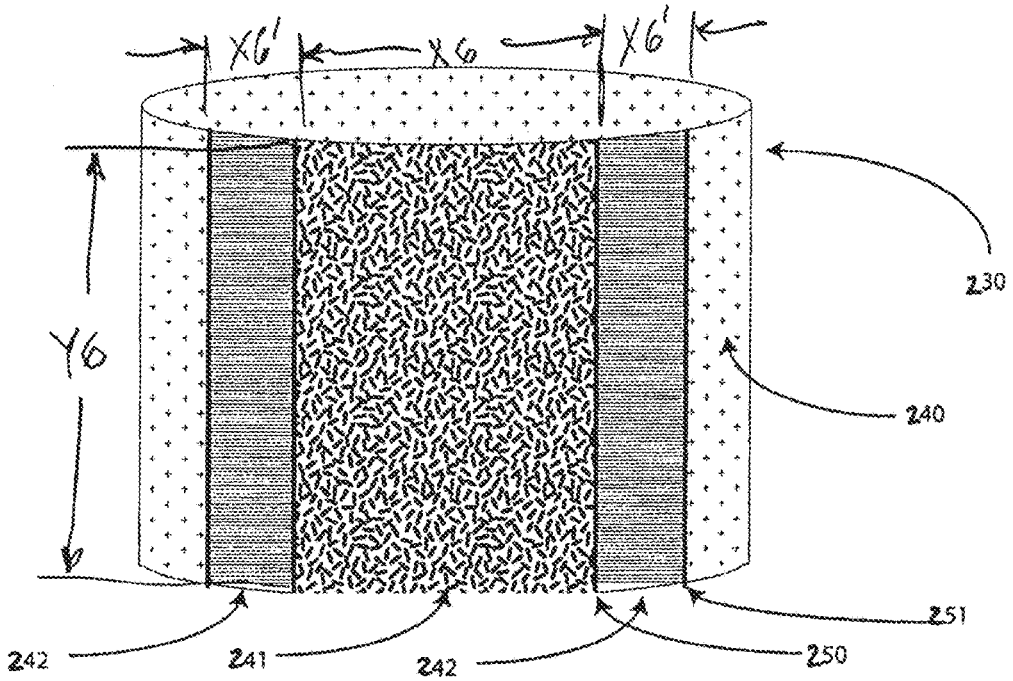
FIG. 6 is a perspective view of a knitted fire barrier fabric according to an embodiment of the present disclosure that includes a non-uniform and non-consistent placement of individual or plaited yarns or thread formed around a circumference of a knitting cylinder. Such non-uniform, non-consistent placement yields four separate zones of fabric whose zones are however proportionally matched to the anticipated placement of the knitted fire barrier fabric over or against the exposed surfaces or edges of a mattress core of design similar to FIG. 3.

FIG. 6 depicts a knitted fire barrier fabric 230 according to an embodiment of the present disclosure that includes of a non-uniform and non-consistent placement of individual or plaited yarns or thread around a circumference of a knitting cylinder (not shown in FIG. 6). Such non-uniform, non-consistent placement yields four separate zones of knitted fire barrier fabric, for example including a first area or zone 240, a second area or zone 241, and two third zones 242, of a similar yarn selection and construction, the zones being proportionally matched to the anticipated placement of the barrier fabric against the exposed edges of a mattress of design similar to FIG. 3. For ease and accuracy of installation, the embodiment depicted in FIG. 6 shows identifiers 250 and 251 that may optionally be integrated into the fabric during the knitting process and may be include a knitting pattern variation, such as a selvedge. The identifiers are intended to assist those installing the barrier over the mattress core to properly orient the differential zones against the intended areas or layers of the mattress core.

First area or zone 240, second area or zone 241, and third areas or zones 242 may include fire-retardant yarns, or first area or zone 240 may include non fire-retardant yarns, second area or zone 241 and third areas or zones 242 may include fire-retardant yarns. The areas or zones may include a combination of non fire-retardant yarns and fire retardant yarns. Other possible types of yarn for the various areas or zone are possible as described further herein.

For example, first area or zone 241 may have a width X6 and a length Y6', and third areas or zones 242 may have a width X6' and a length L6. In some embodiments, such as where knitted fire barrier fabric 230 is generally not stretchable, second area or zone 241 may have width X6 that corresponds to a width of a core of a mattress or a mattress foundation (e.g., corresponding to width X2 of core 20 (FIG. 2)), Third areas or zones 242 may have width X6' that corresponds to a depth of thickness of a core of a mattress or a mattress foundation (e.g., corresponding to depth or thickness Z2 of core 20 of FIG. 2) and length L6 that is greater than a length of a core or a mattress or a mattress foundation, (e.g., greater than length Y2 of core 20 (FIG. 2)). Length L6 may be slightly larger than a combined length and thickness of a core. In other embodiments, such as where knitted fire barrier fabric 230 is not stretchable, second area or zone 241 may have width X6 that is greater than a width of a core or a mattress or a mattress foundation (e.g., greater than width X2 of core 20 (FIG. 2) so as to extend over the edges and at least a portion of the depth or thickness of the core, and third areas or zones 242 may have a thickness X6' is extends over the remaining portion of the depth or thickness of the core. In some embodiments, such as where knitted fire barrier fabric 230 is stretchable, second area or zone 241 may have a width X6 that corresponds to a width of a core of a mattress or a mattress foundation or less than the width of a core of a mattress or mattress foundation, third areas or zones 242 have a width X6' that is less than the depth or thickness of the core, and have length Y6 that is the same or less that the length of a core of a mattress or mattress foundation.

Figure 7:
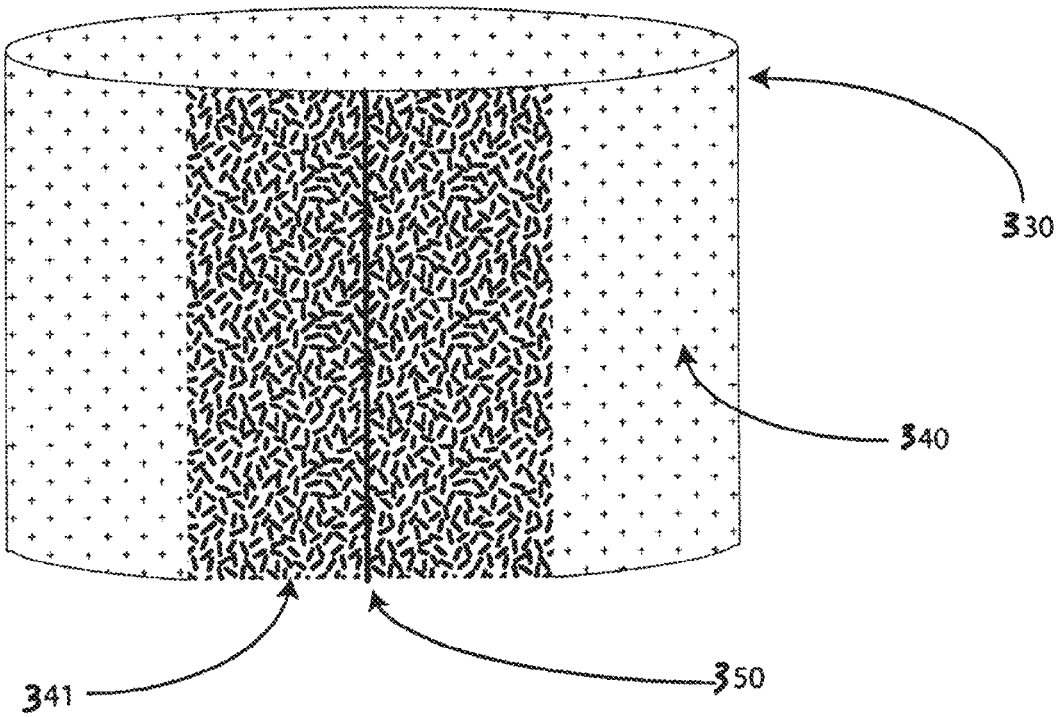
FIG. 7 is a perspective view of a knitted fire barrier fabric according to an embodiment of the present disclosure.

FIG. 7 depicts a knitted fire barrier fabric 330 according to an embodiment of the present disclosure that includes a non-uniform and non-consistent placement of individual or plaited yarns or thread around a circumference of a knitting cylinder (not shown in FIG. 7). Such non-uniform, non-consistent placement yields a two-zone fabric, for example including a first zone 340 and a second zone 341, whose zones are proportionally matched to the anticipated placement of the barrier fabric against the exposed edges of a mattress of design similar to FIG. 2. The fire barrier depicted in FIG. 7 could also be utilized on a mattress of the design depicted in FIG. 1 as an alternative to a pop-on cap approach that would leave a bottom exposed and a bottom zone may include yarns that are non-flame retardant. For ease and accuracy of installation, the embodiment depicted in FIG. 7 shows a single identifier 350 that may optionally be integrated into the fabric during the knitting process and may include a colored yarn or a knitting pattern variation, such as a selvedge. The identifier is intended to assist those installing a barrier over a mattress core to properly orient the differential zones against the intended areas or layers of the mattress core by locating the identifier at the bottom of the mattress or foundation construction and equidistant from any two opposite edges of the bottom, horizontal planar face. For example, second area or zone 341 of knitted fire barrier fabric 330 may have a width and a length as similarly described in connection with knitted fire barrier fabric 130 (FIG. 1).

First area or zone 340 and a second area or zone 341 may include fire-retardant yarns, or first area or zone 340 may include non fire-retardant yarns, and second area or zone 341 may include fire-retardant yarns. The areas or zones may include a combination of non fire-retardant yarns and fire retardant yarns. Other possible types of yarn for the various areas or zone are possible as described further herein.

Figure 8:
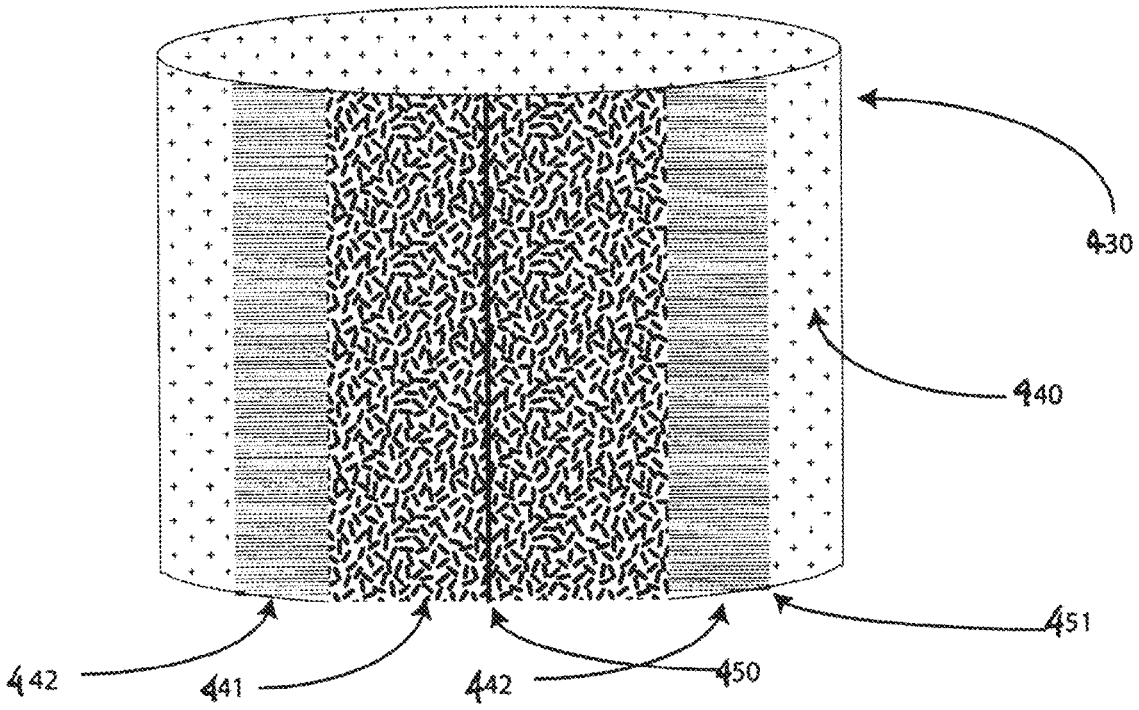
FIG. 8 is a perspective view of a knitted fire barrier fabric according to an embodiment the present disclosure.

FIG. 8 depicts another embodiment of a knitted fire barrier fabric 430 according to an embodiment of the present disclosure that includes a non-uniform and non-consistent placement of individual or plaited yarns or thread around the circumference of a knitting cylinder (not shown in FIG. 7). Such non-uniform, non-consistent placement yields four separate zones of fabric, for example including a first area or zone 440, a second area or zone 441 and two third areas or zones 442, of a similar yarn selection and construction, the zones being proportionally matched to the anticipated placement of the barrier fabric against the exposed edges of a mattress of design similar to FIG. 3. The knitted fire barrier fabric depicted in FIG. 8 could also be utilized on a mattress of the design depicted in FIG. 1 as an alternative to a pop-on cap approach that would leave the bottom exposed and the bottom zone may include yarns that are non-flame retardant. For ease and accuracy of installation, the embodiment depicted in FIG. 8 shows a single identifier 450 that may optionally be integrated into the fabric during the knitting process and may include a colored yarn or a knitting pattern variation, such as a selvedge. The identifier is intended to assist those installing the barrier over the mattress core to properly orient the differential zones against the intended areas or layers of the mattress core by locating the identifier at the bottom of the mattress or foundation construction and equidistant from any two opposite edges of the bottom, horizontal planar face. For example, second area or zone 441 and third areas or zones 442 of knitted fire barrier fabric 430 may have widths and length as similarly described in connection with knitted fire barrier fabric 230 (FIG. 2).

First area or zone 440, second area or zone 441, and third areas or zones 442 may include fire-retardant yarns, or first area or zone 440 may include non fire-retardant yarns, second area or zone 441 and third areas or zones 442 may include fire-retardant yarns. The areas or zones may include a combination of non fire-retardant yarns and fire retardant yarns. Other possible types of yarn for the various areas or zone are possible as described further herein.

Figure 9:
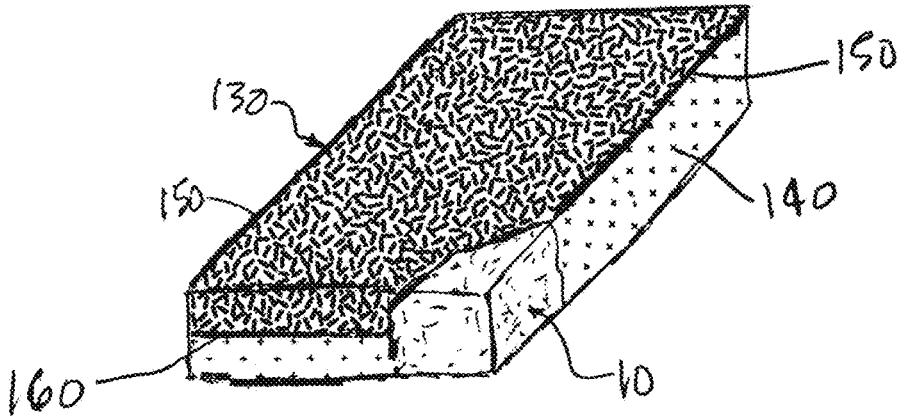
FIG. 9 is a perspective view of a mattress or a mattress foundation having the knitted fire barrier fabric of FIG. 5 disposed on the mattress core of FIG. 1.

FIG. 9 depicts a mattress or a mattress foundation having knitted fire barrier fabric 130 (also shown in FIG. 5) disposed on mattress core 10 (also shown in FIG. 1) according to an embodiment of the present disclosure. Knitted fire barrier fabric 130 may have seams 160 (only one of which is shown in FIG. 9) where the longitudinal ends of knitted fire barrier fabric 130 are sewn together along the foot and the head of the mattress or mattress foundation. Portions of first area or zone 140 extend over the longitudinal sides of the core.

Figure 10:
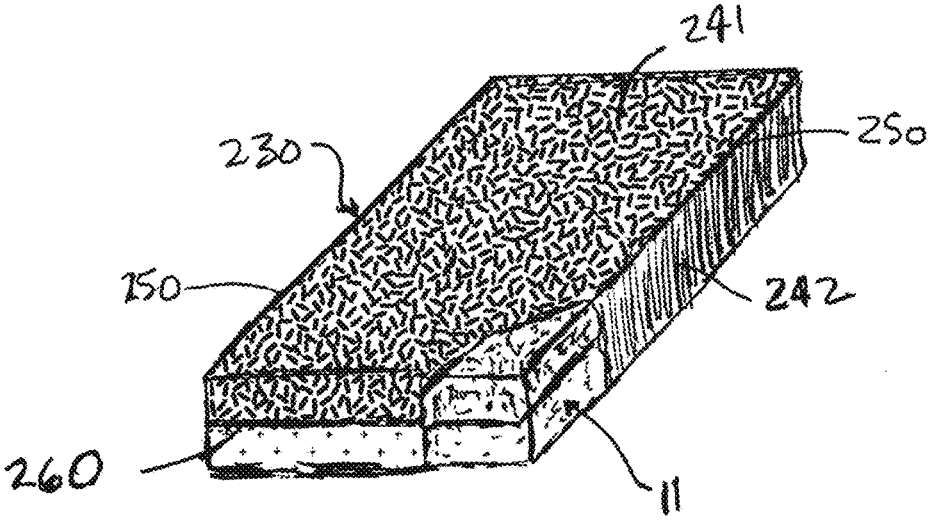
FIG. 10 is a perspective view of a mattress or a mattress foundation having the knitted fire barrier fabric of FIG. 6 disposed on the mattress core of FIG. 2.

FIG. 10 depicts a mattress or a mattress foundation having knitted fire barrier fabric 230 (also shown in FIG. 6) disposed on mattress core 20 (also shown in FIG. 2) according to an embodiment of the present disclosure. Knitted fire barrier fabric 230 may have seams 260 (only one of which is shown in FIG. 10) where the longitudinal ends of knitted fire barrier fabric 230 are sewn together along the foot and the head of the mattress or mattress foundation. Third areas or zones 242 extend over the longitudinal sides of the core.

Figure 11:
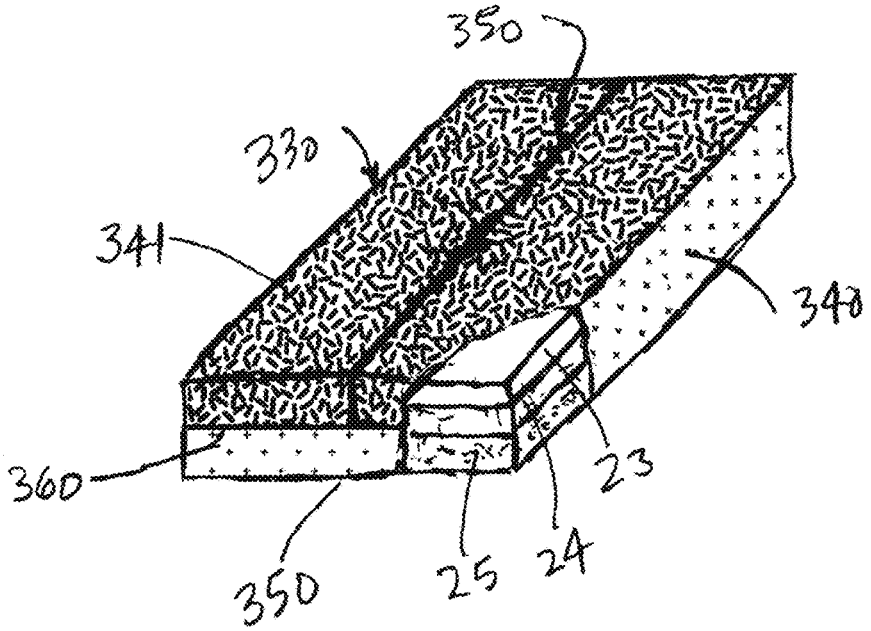
FIG. 11 is a perspective view of a mattress or a mattress foundation having the knitted fire barrier fabric of FIG. 7 disposed on the mattress core of FIG. 3.

FIG. 11 depicts a mattress or a mattress foundation having knitted fire barrier fabric 330 (also shown in FIG. 7) disposed on mattress core 30 (also shown in FIG. 3) according to an embodiment of the present disclosure. Knitted fire barrier fabric 330 may have seams 360 (only one of which is shown in FIG. 10) where the longitudinal ends of knitted fire barrier fabric 330 are sewn together along the foot and the head of the mattress or mattress foundation. Identifier 350 such as a color may be disposed longitudinally along the middle of the mattress or mattress foundation. Portions of first area or zone 340 extend over the longitudinal sides of the core.

Figure 12:
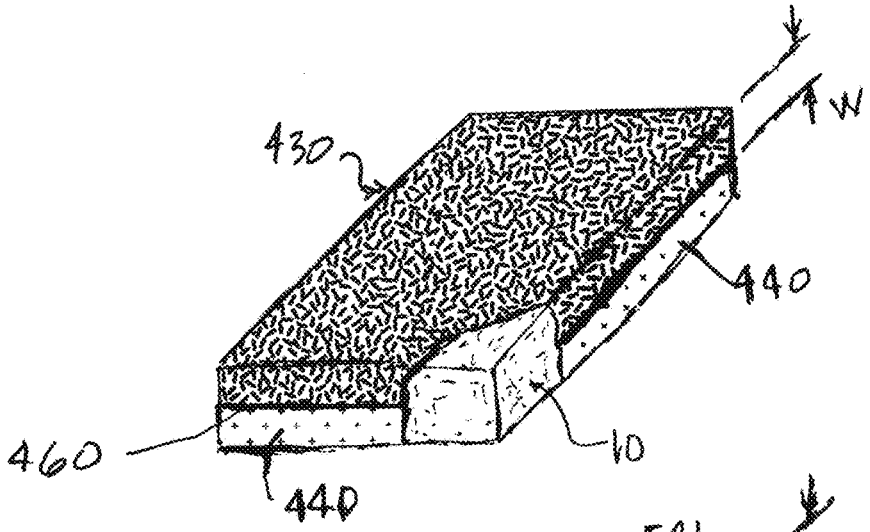
FIG. 12 is a perspective view of a mattress or a mattress foundation having a knitted fire barrier fabric disposed on a core according to an embodiment the present disclosure.

FIG. 12 depicts a mattress or a mattress foundation having knitted fire barrier fabric 430 disposed on mattress core 10 (also shown in FIG. 1) according to an embodiment of the present disclosure. Knitted fire barrier fabric 430 may have seams 460 (only one of which is shown in FIG. 12) where the longitudinal ends of knitted fire barrier fabric 430 are sewn together along the foot and the head of the mattress or mattress foundation. Portions of a first area or zone 440 and portions of a second area or zone extend over the longitudinal sides of core 10. For example, the second area or zone may extend a distance W such as half the width or other suitable distance over the sides of the core. Portions of first area or zone 440 may also extend along the bottom of the core.

Figure 13:
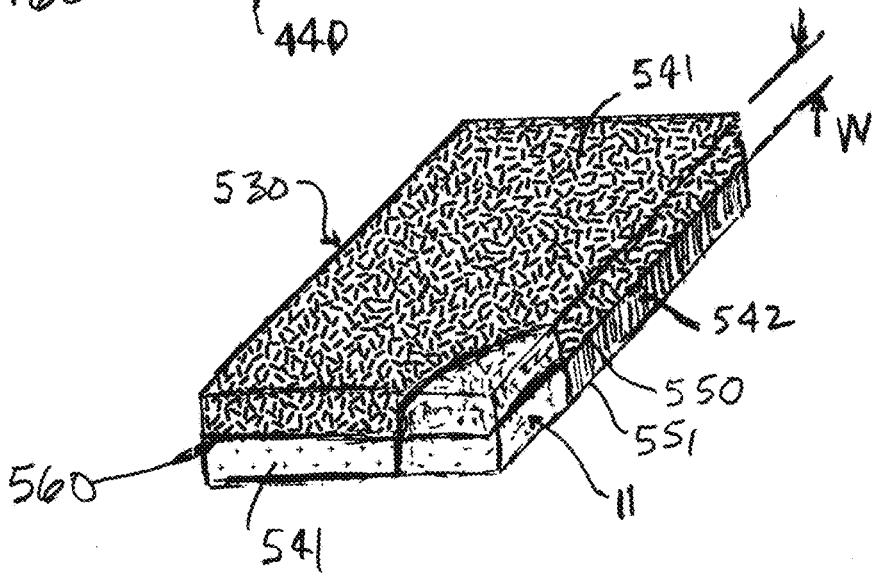
FIG. 13 is a perspective view of a mattress or a mattress foundation having a knitted fire barrier fabric disposed on a core according to an embodiment the present disclosure.

FIG. 13 depicts a mattress or a mattress foundation having knitted fire barrier fabric 530 disposed on mattress core 11 (also shown in FIG. 2) according to an embodiment of the present disclosure. Knitted fire barrier fabric 530 may have seams 560 (only one of which is shown in FIG. 13) where the longitudinal ends of knitted fire barrier fabric 530 are sewn together along the foot and the head of the mattress or mattress foundation. Portions of a second area or zone 541 and portions of third areas or zones 542 may extend over the longitudinal sides of core 11. For example, second area or zone 541 may extend a distance W such as half the width or other suitable distance over the sides of the core. The width of the third areas or zones may have a width equal to the remainder of the sides of the core. A first area or zone 541 may also extend along the bottom of the core.

Figure 14:
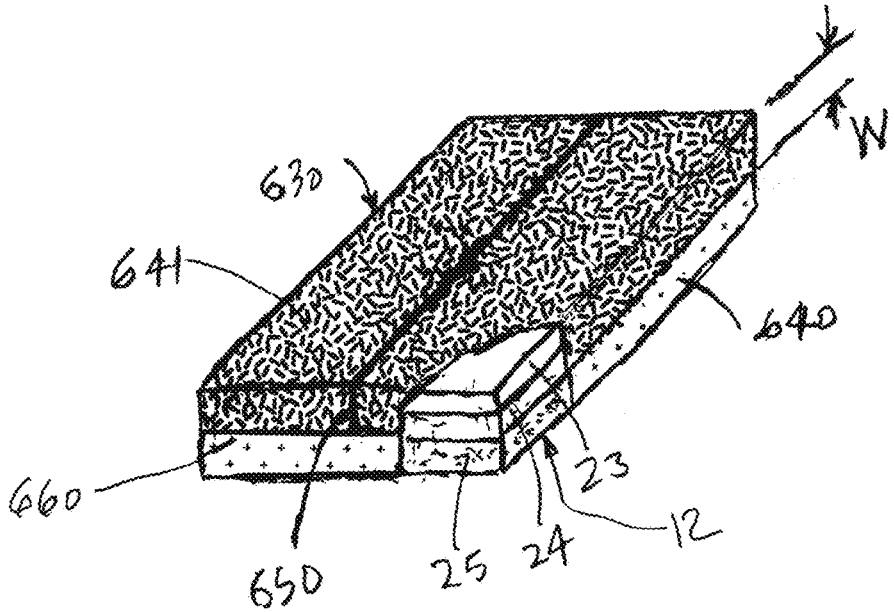
FIG. 14 is a perspective view of a mattress or a mattress foundation having a knitted fire barrier fabric disposed on a core according to an embodiment the present disclosure.

FIG. 14 depicts a mattress or a mattress foundation having knitted fire barrier fabric 630 disposed on mattress core 12 (also shown in FIG. 3) according to an embodiment of the present disclosure. Knitted fire barrier fabric 630 may have seams 660 (only one of which is shown in FIG. 13) where the longitudinal ends of knitted fire barrier fabric 630 are sewn together along the foot and the head of the mattress or mattress foundation. Portions of a second area or zone 641 and portions of a first area or zone 640 may extend over the longitudinal sides of core 11. For example, second area or zone 641 may extend a distance W such as half the width or other suitable distance over the sides of the core. Portions of first area or zone 640 may also extend along the bottom of the core.

As described above, generally a tubular knitted fire barrier fabric may be installed from foot to head or vice versa. The tubular knitted fire barrier fabric may be knitted in three or four different size widths to accommodate the progressively wider nature of mattresses from twin to full to queen to king. Mattresses of all sizes/widths though tend to be one of two lengths (75 inches from head to foot (twin/full) or 80" (twin extra long, full XL, queen or king).

Figure 15:
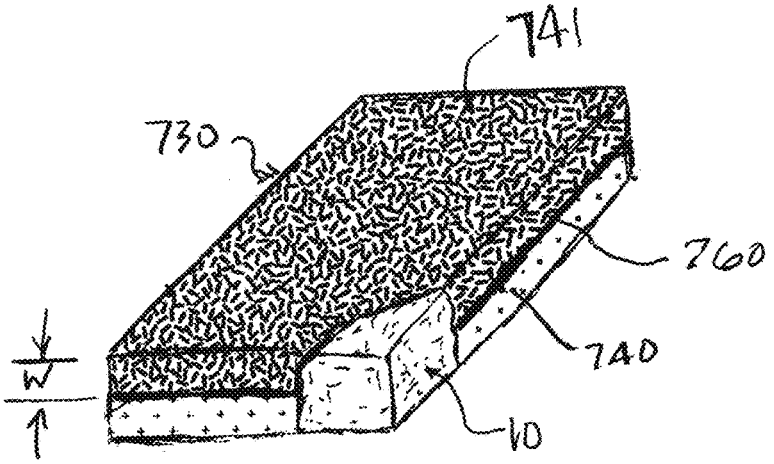
FIG. 15 is a perspective view of a mattress or a mattress foundation having a knitted fire barrier fabric disposed on a core according to an embodiment the present disclosure.
Figure 16:
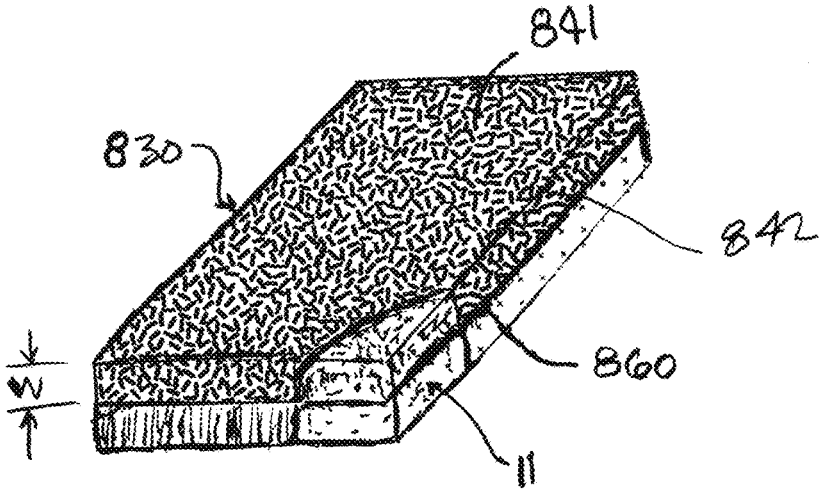
FIG. 16 is a perspective view of a mattress or a mattress foundation having a knitted fire barrier fabric disposed on a mattress core according to an embodiment the present disclosure.
Figure 17:
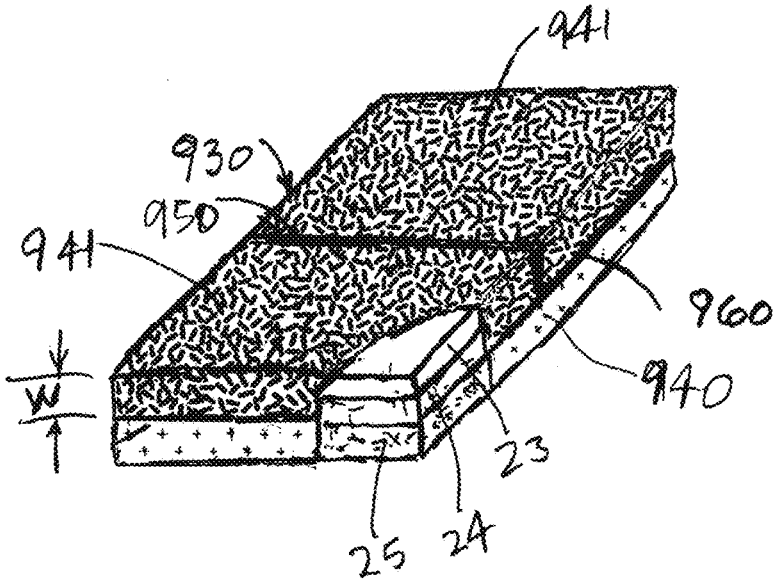
FIG. 17 is a perspective view of a mattress or a mattress foundation having a knitted fire barrier fabric disposed on a core according to an embodiment the present disclosure.

In some instances, for example, to reduce inventory SKU count, a mattress manufacturer may buy one size tube (e.g., the widest) and install it sideways rather than head to foot, such as shown in FIG. 15-17.

FIG. 15 depicts a mattress or a mattress foundation having knitted fire barrier fabric 730 installed sideways on mattress core 10 (also shown in FIG. 1) according to an embodiment of the present disclosure. Knitted fire barrier fabric 730 may have seams 760 (only one of which is shown in FIG. 15) where the longitudinal ends of knitted fire barrier fabric 730 are sewn together along the longitudinally-extending sides of the mattress or mattress foundation. Portions of a first area or zone 740 and portions of a second area or zone 741 extend over the sides of core 10. For example, second area or zone 741 may extend a distance W, such as half the width or other suitable distance over the sides of the foot and head of the core. Portions of first area or zone 740 may also extend along the bottom of the core.

FIG. 16 depicts a mattress or a mattress foundation having knitted fire barrier fabric 830 installed sideways on mattress core 11 (also shown in FIG. 2) according to an embodiment of the present disclosure. Knitted fire barrier fabric 830 may have seams 860 (only one of which is shown in FIG. 16) where the longitudinal ends of knitted fire barrier fabric 830 are sewn together along longitudinally-extending sides of the mattress or mattress foundation. Portions of a second area or zone 841 and portions of first area or zone 840 may extend over the longitudinal sides of core 11. Portions of a second area or zone 841 and portions of third areas or zones 842 may extend over the side of the foot and head of core 11. For example, second area or zone 841 may extend a distance W such as half the width or other suitable distance over the sides of the foot and head of the core. The width of the third areas or zones may have a width equal to the remainder of the sides of the foot or head of the core. A first area or zone 841 may also extend along the bottom of the core.

FIG. 17 depicts a mattress or a mattress foundation having knitted fire barrier fabric 930 installed sideways on mattress core 12 (also shown in FIG. 3) according to an embodiment of the present disclosure. Knitted fire barrier fabric 930 may have seams 960 (only one of which is shown in FIG. 17) where the longitudinal ends of knitted fire barrier fabric 930 are sewn together along longitudinally-extending sides of the mattress or mattress foundation. Portions of a second area or zone 941 and portions of a first area or zone 940 may extend over the longitudinal sides of core 11. For example, second area or zone 941 may extend a distance W such as half the width or other suitable distance over the sides of the core. Portions of first area or zone 940 may also extend along the bottom of the core.

In the various embodiments, the identifiers may be used for aligning the knitted fire barrier to the core of the mattress or mattress foundation so that the identifiers are visible on the outer surface of the installed knitted fire barrier. In other embodiments, identifiers may be used for aligning the knitted fire barrier to the core of the mattress or mattress foundation so that the identifiers are disposed underneath and are generally not visible on the outer surface of the installed knitted fire barrier. In other embodiment, the different portions (e.g., thickness, material, etc.) of the knitted fire barrier where they abut each other may themselves provide an indication for aligning the knitted fire barrier to the different portions of the core of the mattress or mattress foundation.

While in the various embodiments identifier 350 may be disposed on top of the matters or mattress foundation, it may be desirable that the identifier not be disposed on the top. For example, an identifier may be disposed in a first area or zone so that it is disposed on the bottom of the mattress foundation. In addition, while the embodiments of the present disclosure are illustrated with the first area or zone of the knitted fire barrier fabric being generally disposed on the bottom surface of the core, it will be appreciated that the first zone or area of the knitted fire barrier fabric may disposed on the top surface of the core.

The use of a knitted pattern identifier to facilitate proper orientation of the differentially knitted fire barrier is one means of aiding the installation process. It would also be contemplated that newer knitting techniques, particularly sophisticated, electronic knitting machines, that permit the forming of words, images or symbols into the fabric could be used to impart such words (for example "bottom"), images or symbols (for example an arrow), or colored yarns which could serve in the same manner as the yarns as being a visual cue for the proper placement and orientation of the barrier. A marking system could also be employed that would be synchronized to the transition points from one density to another that would impart a colored or visual mark to the fabric delineating the differential protective zones.

Additionally, the decision of how to match protective zones in the fire barrier to zones of risk based on the construction of the mattress or mattress foundation may be left to collaboration between the barrier manufacturer and the mattress or mattress foundation manufacturer.

It may be determined, for instance that a two-layer mattress may be performance optimized through use of a barrier system with four distinct zones, as indicated by the embodiment depicted in FIG. 6 or 8 as opposed to a barrier system with two distinct zones.

While the described embodiments employ the knitted fire barrier fabric being installed to completely surround the core, it will be appreciated that the knitted fire barrier fabric may at least partially enclose or surround the core. In other embodiment, the knitted fire barrier fabric may be disposed entirely or partially over only a top or a bottom, a top and sides, or other portions of a core.

The above described embodiments may include the following features. The at least one differential zone may be identified and segregated by a knitting pattern, a selvedge, knitting patterns, or selvedges. The knitting pattern or knitting patterns may form one or more word, image, or symbol. The at least one differential zone may be identified and segregated by a color or an optically visible mark applied to the fabric during manufacture. The at least one differential zone may include two distinct differential zones having identical yarn selections that are knitted at different concentrations yielding differential material weights in the respective zones. The at least one differential zone may include two distinct differential zones comprised of different yarn selections that are knitted at identical concentrations yielding similar material weights in the respective zones. The at least one differential zone may include more than two distinct differential zones comprising identical yarn selections that are knitted at different concentrations yielding differential material weights in each of the respective zones. The at least one differential zone may include more than two distinct differential zones comprising different yarn selections that are knitted at identical concentrations yielding similar material weights in the respective zones. The at least one differential zone may include a plurality of distinct differential zones having different yarn selections that are knitted at different concentrations yielding differential material weights in the respective zones. The plurality of flame-retardant yarns may include corespun yarns with a fiberglass core. The plurality of flame-retardant yarns may include fiberglass, modacrylic, flame retardant rayon, aramid, or carbon yarns. The plurality of flame-retardant yarns may include chemically treated flame-retardant yarns.

In the present embodiments, the knitted fire barrier fabric may include solely flame-retardant fibers, or a combination of flame-retardant fibers and non-flame-retardant fibers. The differential areas and zones may all be flame-retardant areas or zones, or some of the differential areas and zones may be flame-retardant areas or zones and other of the differential areas and zones may be non-flame-retardant areas or zones. For example, flame-retardant areas or zones maybe disposed on the top surface of a core and non-flame-retardant areas or zones may be disposed on the bottom of the core.

The knitted fire barrier fabric may have or be formed from a tubular form having a width of greater than about 10 inches, greater than about 20 inches, greater than about 30 inches, greater than about 50 inches, greater than about 60 inches, greater than about 75 inches, between about 30 inches and about 76 inches, between about 30 inches and about 38 inches, between about 43 inches and about 53 inches, between about 53 inches and about 60 inches, between about 58 inches and about 76 inches, between about 64 inches and about 72 inches, between about 30 inches and about 70 inches, or other suitable widths.

There are a variety of benefits to be derived from the present disclosure, including cost saving, manufacturing efficiency and raw material conservation.

The above examples serve to elucidate possible embodiments of the present disclosure. It will be evident to one skilled in the art that the scope of the disclosure is not limited to the above stated examples, but can extended to include a variety of home furnishings or filled articles, such as transportation seating, healthcare cushioning or support articles among others, in a variety of dimensions and configurations. Additionally, the dimensions, and number of constituting materials do not serve to limit the disclosure in any way, as will be apparent to one skilled in the art.

Example 1

A twin sized mattress core is fashioned from two different foam layers. The total dimension of the mattress core is 38" wide by 74½" long by 10" thick. The first or bottom layer of foam may be a standard polyurethane foam with no added chemical flame retardants. The bottom layer of standard polyurethane foam measured 38" wide by 74½" long by 8½" thick and had a density of 1.8 pounds and an ILD of no less than 35. Affixed with glue to the bottom layer is a top layer of natural latex foam measuring 38" wide by 74½" long by 1½" thick with an ILD of approximately 15.

A fire barrier is designed, in accordance with the techniques of the present disclosure, to target the protective capacity of the selected yarns and fibers for the fire barrier construction to the flammability profile of the layers of the mattress core. Since the mattress is a twin sized mattress, the tubular width of the barrier is targeted at a non-relaxed with of 35-36" tubular.

The linear measurement of the externally exposed surface area of the bottom layer of polyurethane foam is determined to be 55" (38" plus 8½" plus 8½"=55") and the linear measurement of the externally exposed surface area of the top layer of natural latex foam is determined to be 41" (38" plus 1½" plus 1½"=41").

As the total linear measurement around the girth of the mattress totals 96" (38" plus 38" plus 10" plus 10"=96") it is determined that the construction of the knitted fire barrier fabric with differential protective zones should be formed so that the protective zone allocated to the more volatile natural latex foam layer should be at least 43 percent (43%) of the tubular circumference of the fabric as the externally exposed portion of the more volatile latex foam is 41" divided by 96"=42.7%.

Given the goal of protecting the more volatile fuel load and the potential lack of precision of installation practices, a conservative design approach would be to extend the differential protective zone matched to the more volatile fuel load beyond the margins of the more volatile fuel load layer, so an initial ratio of 60% of the tubular circumference of the fabric is selected for deployment of the heavier, more robust barrier construction and the remaining 40% of the tubular circumference will be of a lighter, less robust barrier construction.

Past successful tests of natural latex foam mattresses indicate a potentially successful yarn combination for the heavier, more robust section matched to the more volatile fuel load layer may include two plaited yarns sized 11/1 cotton count equivalent made of a corespun yarn with a filament fiberglass core and a wrapper or sheath having flame retardant blends of modacrylic and flame retardant rayon staple fibers. The target weight of the more robust section representing approximately 65% of the circumference of the knitted fabric cylinder is targeted at a basis weight or material concentration of 7 ounces per square yard.

The remaining portion of the knitted fire barrier fabric, approximately 35% of the circumference of the knitted fabric cylinder is formed using the same yarns but reducing the concentration of the yarns in the knitting operation so as to deliver a material concentration that is 30% less than the more robust zone, or at a basis weight or material concentration of approximately 5 ounces per square yard.

The identifiers are created by knitting a selvedge at the transition points from the 65% zone to the 35% zone. The yarns for the selvedge are flame retardant so as to maintain protective capacity without interruption.

The knitted fire barrier fabric once formed is cut to the appropriate length to encapsulate the mattress core. One end of the knitted fire barrier fabric was closed with a Tex 50 para-aramid thread and then the sock formed by this closure was pulled over the core. The orientation of the knitted fire barrier as identified by the selvedges caused the 65% zone with target of basis weight of 15 oz. per square yard to be proportionally and evenly disposed across the topmost horizontal planar surface of the mattress core and the 35% zone with target basis weight of 10 oz. per square yard to be proportionally and evenly disposed across the bottommost horizontal planar surface of the mattress core. The selvedge was checked and confirmed to be equidistant from the side edges of the mattress core in its position that bisected the bottommost horizontal planar surface of the mattress core.

The open end of the barrier was also sewn closed with para-aramid thread. Alternatives to the para-aramid thread could include plastic tack, metal or plastic staples, glue or other fastening systems deemed suitable and fit for use by the mattress manufacturer.

A cover was installed over the fire barrier encapsulated mattress core and closed according to its design.

The mattress was made in triplicate specimens and subjected to full-scale fire testing according to 16 CFR 1633 and achieved a passing/compliant test results and status as a Qualified Prototype.

The immediate benefit derived from the use of this novel approach to forming a knitted fire barrier with differential protective zones in this specific example is that 40% of the material may include a materials cost savings approaching 24% of the raw materials and yield cost savings to the mattress manufacturer of 10% to 15% of normal pricing.

Using different relative concentrations of yarns in the various zones of the knitted fabric may require adjustments in the percentages of feed positions around the cylinder to be made. The yarns found in the lighter weight zone or zones of the fabric may be made to stretch to a greater degree by the collective mass and strength of the yarns in the heavier weight zone or zones. The impact may be that in order for the installed fabric to be best matched to the zones of the mattress layers that adjustments need to be made to the calculated ratios to offset this impact.

The potential flammability of certain mattress components may necessitate the use of multiple knitted fabrics, tubes, or socks according to embodiments of the present disclosure installed sequentially, one on top of the other in order to deliver the appropriate protective level of localized, flame retardant yarns matched to the differential flammability threats of these materials. The present disclosure fully contemplates this approach.

In some embodiments, the knitted fire barrier fabric is formed in tubular or cylindrical in form having a closed end. The closed end may be aligned along a core, for example with the closed end corresponding to one of the sewn seams described above. In other embodiments, if the knitted fire barrier fabric is slit open from the tubular form, it can be either quilted into the traditional ticking construction or fashioned into a "pop-on" cap style assembly, similar to the design of a fitted sheet or a shower-cap with a sewn hem that may or may not be elasticized to promote fit and positioning stability, that is installed interior to the ticking assembly and covers the topmost horizontal planar face of the mattress, the four vertical planar faces ("borders") of the mattress and a limited perimeter of the bottom horizontal planar face of the mattress, but not the totality of the bottom panel. In other embodiments, the present disclosure in the form of a sock closed on one end, manufactures may ultimately sew it closed on other end after pulling it over the mattress core. Alternatively, the end may be closed by gluing or fastening, or a tubular fabric slit open along one side so as to lay flat and may be sewn into a cap like structure for installation onto a mattress core.

As noted above, while installation of the knitted material of the present disclosure may include tubular knits being installed from the head or foot orientation of the mattress. Additionally, the knitted material of the present disclosure may include tubular knits being installed on mattresses and mattress foundations from the side of the mattress. This orientation of installation may permit a circular knitted fabric to be further constructed according to the differential method described herein in such a manner as to select from a variety of different yarns as well as to employ the differential concentration approach contemplated by this disclosure.

It is expected that such adjustments may be made on a case-by-case basis and be subject to some trial and results evaluation, however, over time, this compensation adjustments are expected to be more predictable in nature.

It is to be understood that the above description is intended to be illustrative, and not restrictive. Numerous changes and modifications may be made herein by one of ordinary skill in the art without departing from the general spirit and scope of the disclosure as defined by the following claims and the equivalents thereof. For example, the above-described embodiments (and/or features thereof) may be used in combination with each other. In addition, many modifications may be made to adapt a particular situation or material to the teachings of the various embodiments without departing from their scope. While the dimensions and types of materials described herein are intended to define the parameters of the various embodiments, they are by no means limiting and are merely exemplary. Many other embodiments will be apparent to those of skill in the art upon reviewing the above description. The scope of the various embodiments should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Also, the term "operably" in conjunction with terms such as coupled, connected, joined, sealed or the like is used herein to refer to both connections resulting from separate, distinct components being directly or indirectly coupled and components being integrally formed (i.e., one-piece, integral or monolithic). Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure. It is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

While the disclosure has been described in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments have been described, it is to be understood that the disclosure may include only some of the features of the described embodiments. Accordingly, the disclosure is not to be seen as limited by the foregoing description, but is only limited by the scope of the appended claims.

This written description uses examples, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A knitted fire barrier fabric for use in forming a flame retardant article having a core, the knitted fire barrier fabric comprising:

a unitarily knitted form comprising a plurality of yarns, said plurality of yarns defining said unitarily knitted form having a longitudinal knitted direction, and said unitarily knitted form comprising a plurality of differential zones of knitted material extending side-by-side in said longitudinal knitted direction; and wherein said knitted fire barrier fabric being disposable on the core so that at least one of said plurality of differential zones of knitted material of said knitted fire barrier fabric provides a differential protective capacity to at least one selected portion of the flame retardant article.

2. The knitted fire barrier fabric of claim 1 wherein when said knitted fire barrier fabric is incorporated in a flame retardant article, and said flame retardant article satisfies at least one flammability standard when tested with said knitted fire barrier fabric.

3. The knitted fire barrier fabric of claim 1 wherein when said knitted fire barrier fabric is incorporated in a mattress assembly, and said mattress assembly satisfies the flammability standards of both 16 CFR 1632 and 16 CFR 1633 when tested with said knitted fire barrier fabric.

4. The knitted fire barrier fabric of claim 1 wherein said plurality of yarns comprises at least one flame-retardant yarn.

5. The knitted fire barrier fabric of claim 1 wherein one or more of said plurality of yarns comprises a chemically treated flame-retardant yarn.

6. The knitted fire barrier fabric of claim 1 wherein said unitarily knitted form is subject to a chemical flame retardant treatment.

7. The knitted fire barrier fabric of claim 1 wherein said at least one of said plurality of differential zones of knitted material is identified and segregated by a knitting pattern, a selvedge, knitting patterns, or selvedges.

8. The knitted fire barrier fabric of claim 1 wherein said at least one of said plurality of differential zones of knitted material is identified and segregated by a knitting pattern that forms a word, an image, or a symbol.

9. The knitted fire barrier fabric of claim 1 wherein said at least one of said plurality of differential zones of knitted material is identified and segregated by a color or an optically visible mark applied to the fabric during manufacture.

10. The knitted fire barrier fabric of claim 1 wherein said at least one-of said plurality of differential zones of knitted material comprises two distinct differential zones of knitted material comprising identical yarn selections that are knitted at different concentrations yielding differential material weights in the respective zones.

11. The knitted fire barrier fabric of claim 1 wherein said at least one-of said plurality of differential zones of knitted material comprises two distinct differential zones of knitted material comprising different yarn selections that are knitted at identical concentrations yielding similar material weights in the respective zones.

12. The knitted fire barrier fabric of claim 1 wherein said at least one of said plurality of differential zones of knitted material comprises more than two distinct differential zones of knitted material comprising identical yarn selections that are knitted at different concentrations yielding differential material weights in each of the respective zones.

13. The knitted fire barrier fabric of claim 1 wherein said at least one of said plurality of differential zones of knitted material comprises more than two distinct differential zones of knitted material comprising different yarn selections that are knitted at identical concentrations yielding similar material weights in the respective zones.

14. The knitted fire barrier fabric of claim 1 wherein said at least one of said plurality of differential zones of knitted material comprises a plurality of distinct differential zones comprising different yarn selections that are knitted at different concentrations yielding differential material weights in the respective zones.

15. The knitted fire barrier fabric of claim 1 wherein said knitted fire barrier fabric comprises a tubular form closed at one end, or a tubular form slit along the width.

16. The knitted fire barrier fabric of claim 1 wherein said plurality of yarns comprises corespun yarns with a fiberglass core.

17. The knitted fire barrier fabric of claim 1 wherein said plurality of yarns comprises fiberglass, modacrylic, flame retardant rayon, aramid, or carbon yarns.

18. The knitted fire barrier fabric of claim 1 wherein said knitted fire barrier fabric comprises or is formed from a tubular form having a width of greater than about 10 inches.

19. The knitted fire barrier fabric of claim 1 wherein said knitted fire barrier fabric comprises or is formed from a tubular form having a width of greater than about 30 inches.

20. The knitted fire barrier fabric of claim 1 wherein said knitted fire barrier fabric comprises or is formed from a tubular form having a width between about 30 inches and about 70 inches.

21. The knitted fire barrier fabric of claim 1 wherein said plurality of yarns comprises a plurality of flame-retardant yarns and a plurality of non flame-retardant yarns, and said knitted fire barrier fabric having said unitarily knitted form comprising said plurality of differential zones of knitted material comprising at least one flame-retardant differential zone of knitted material.

22. The knitted fire barrier fabric of claim 21 wherein said knitted fire barrier fabric comprises a tubular form having a width of greater than about 10 inches.

23. The knitted fire barrier fabric of claim 21 wherein said knitted fire barrier fabric comprises a tubular form having a width of greater than about 30 inches.

24. The knitted fire barrier fabric of claim 21 wherein said knitted fire barrier fabric comprises a tubular form having a width between about 30 inches and about 70 inches.

25. An article of furniture comprising:

a core; and said knitted fire barrier fabric of claim 1 at least partially covering said core.

26. An article of resilient cushioning material, a resilient core; and said knitted fire barrier fabric of claim 1 at least partially covering said resilient core.

27. A method for assembling an article, the method comprising:

providing a core;

providing said knitted fire barrier fabric of claim 1; and covering at least a portion of the core with said knitted fire barrier fabric.

28. The method of claim 27 wherein the covering comprises aligning visual identification of the differential zones relative to the core.

29. An article comprising:

a core;

a knitted fabric comprising a unitarily knitted form with a plurality of yarns, said plurality of yarns defining said unitarily knitted form having a longitudinal knitted direction, and said unitarily knitted form comprising a plurality of differential zones of knitted material extending side-by-side in said longitudinal knitted direction; and wherein said plurality of differential zones of knitted material of said knitted fabric being disposed on said core so that said plurality of differential zones of knitted material of said knitted fabric provide differential protective capacities to selective portions of said article.

30. The article of claim 29 wherein said knitted fabric comprises a tubular form.

31. The article of claim 29 wherein at least one of said plurality of yarns comprises chemically treated flame-retardant yarns.

32. The article of claim 29 wherein said knitted fabric comprises a knitted fire barrier fabric.

33. The article of claim 29 wherein said plurality of yarns comprises a plurality of flame-retardant yarns and a plurality of non flame-retardant yarns, and said knitted fabric having said unitarily knitted form comprising said plurality of differential zones of knitted material comprising at least one flame-retardant differential zone of knitted material.

34. The article of claim 29 wherein said article comprises a mattress, a mattress foundation, or set of bedding thereof.

35. The article of claim 29 wherein said article comprises an article of furniture.

36. The article of claim 29 wherein said article comprises an article of resilient cushioning material.

37. The article of claim 29 wherein said plurality of differential zones of knitted material is identified and segregated by a pattern, a selvedge of yarns, or a plurality of patterns or selvedges.

38. The article of claim 29 wherein said plurality of differential zones of knitted material comprises a) two distinct differential zones of knitted material comprising identical yarn selections that are disposed at different concentrations yielding differential material weights in the respective zones, b) two distinct differential zones of knitted material comprising different yarn selections that are disposed at identical concentrations yielding similar material weights in the respective zones; or c) a plurality of distinct differential zones of knitted material comprising different yarn selections that are disposed at different concentrations yielding differential material weights in the respective zones.

39. Mattress or a mattress foundation comprising:

core comprises a top, a bottom, and a peripherally-extending sidewall disposed between said top and said bottom, said core having a width and a length;

a knitted fire barrier fabric comprising a unitarily knitted form with a plurality of yarns, said plurality of yarns defining said unitarily knitted form having a longitudinal knitted direction, and said unitarily knitted form comprising a plurality of differential zones of knitted material extending side-by-side in said longitudinal knitted direction; and wherein said differential zones of knitted material being disposed over at least a portion of said core.

40. The mattress or a mattress foundation of claim 39 wherein said pattern, said selvedge of yarns, or said plurality of patterns or selvedges being disposed between edges of said sidewall of said core.

41. The mattress or a mattress foundation of claim 39 wherein said knitted fire barrier fabric comprises said differential zones of knitted material identified and segregated by a pattern, a selvedge of yarns, or a plurality of patterns or selvedges.

42. The mattress or a mattress foundation of claim 41 wherein said pattern, said selvedge of yarns, or said plurality of patterns or selvedges being disposed along edges between said top and said sidewall of said core.

43. The mattress or a mattress foundation of claim 39 wherein said knitted fire barrier fabric comprises a plurality of flame-retardant yarns and a plurality of non flame-retardant yarns so as to define said knitted fire barrier fabric having at least one flame-retardant differential zone of knitted material.

44. The mattress or a mattress foundation of claim 43 wherein a different one of said plurality of said differential zones of knitted material being disposed over a top surface of said core.

45. The mattress or a mattress foundation of claim 44 wherein said different one of said of plurality said differential zones of knitted material being disposed over the entire top surface of said core.

46. A method for forming a knitted fire barrier fabric for a flame retardant article comprising:

providing a plurality of yarns;

knitting the plurality of yarns non-uniformly around a circumference of a knitting textile cylinder so that the plurality of yarns define a tubular unitarily knitted fire barrier fabric having a longitudinal knitted direction and having a plurality of differential zones of knitted material extending side-by-side in said longitudinal knitted direction; and wherein said knitted fire barrier fabric being disposable on a core so that at least one of said plurality of differential zones of knitted material of the knitted fire barrier fabric provides a differential protective capacity to at least one selected portion of the flame retardant article.

47. The method of claim 46 wherein the knitting comprises knitting an observable demarcation on or between the plurality of differential zones of knitted material.

48. The method of claim 46 wherein at least one of the plurality of yarns comprise at least one flame retardant yarn.

49. The method of claim 46 further comprising treating the knitted fabric to a chemical flame retardant treatment.

* * * * *